US012708230B2

(12) United States Patent
Moss

(10) Patent No.: US 12,708,230 B2
(45) Date of Patent: Aug. 18, 2026

(54) ROD CONNECTOR SYSTEM AND METHODS OF USE

(71) Applicant: House of Atlas, LLC, Evanston, IL (US)

(72) Inventor: Jason Moss, Libertyville, IL (US)

(73) Assignee: House of Atlas, LLC, Evanston, IL (US)

( * ) Notice: Subject to any disclaimer, the term of this patent is extended or adjusted under 35 U.S.C. 154(b) by 47 days.

(21) Appl. No.: 18/418,084

(22) Filed: Jan. 19, 2024

(65) Prior Publication Data

US 2025/0235025 A1 Jul. 24, 2025

(51) Int. Cl.
*A47H 1/02* (2006.01)
*A47H 1/00* (2006.01)

(52) U.S. Cl.
CPC ..... *A47H 1/02* (2013.01); *A47H 2001/003* (2013.01); *A47H 2001/021* (2013.01)

(58) Field of Classification Search
CPC .. F16B 12/40; F16B 2012/403; Y10T 403/55; Y10T 403/57; Y10T 403/556; Y10T 403/5741; Y10T 403/5733; A47H 2023/003; A47H 1/02; A47H 1/022; A47H 2001/021; A47H 2001/0205; E04C 5/165
See application file for complete search history.

(56) References Cited

U.S. PATENT DOCUMENTS 2,233,901 A 3/1941 Scacchetti
2,400,941 A 5/1946 Mcfarlane
2,703,724 A 3/1955 Frank
3,406,443 A 10/1968 De Ridder
D254,752 S * 4/1980 Gabriel ..... D25/164
4,484,831 A 11/1984 Hanson, Jr.
D281,440 S * 11/1985 Petersson ..... D21/487
4,701,065 A 10/1987 Orosa
4,919,561 A 4/1990 Kee
4,923,319 A 5/1990 Dent
(Continued)

FOREIGN PATENT DOCUMENTS

CA 3000381 A1 * 10/2019 ..... A63H 33/008
CH 588038 A5 * 5/1977 ..... F16B 12/40

OTHER PUBLICATIONS

Photographs and Installation Instructions of Better Home & Gardens Add-On Curtain Rod product, publicly available at least before Nov. 18, 2024, 5 pages.
(Continued)

*Primary Examiner* — Patrick D Hawn
(74) *Attorney, Agent, or Firm* — Fitch, Even, Tabin & Flannery LLP

(57) ABSTRACT

A rod connector is provided having a body defining a first shaft portion, a second shaft portion, and a circumferential ridge projecting radially from the body between the first shaft portion and the second shaft portion. The first shaft portion is configured to engage a first rod and the second shaft portion is configured to engage the second rod. In some embodiments, the first rod and the second rod abut the circumferential ridge when the rod connector is inserted into the first rod and the second rod, the circumferential ridge providing a smooth transitional surface between the first rod and the second rod.

16 Claims, 22 Drawing Sheets

(56) References Cited

U.S. PATENT DOCUMENTS

| | | | | |
|---|---|---|---|---|
| 5,881,515 | A * | 3/1999 | George | E04B 2/702 52/169.4 |
| 6,073,642 | A | 6/2000 | Huang | |
| 6,260,488 | B1 * | 7/2001 | Yang | F16B 12/40 108/107 |
| 6,626,605 | B1 * | 9/2003 | Dean | F16B 7/0413 403/379.6 |
| 6,840,702 | B2 | 1/2005 | Ko | |
| 7,186,050 | B2 * | 3/2007 | Dean | F16B 7/0413 403/379.6 |
| 7,736,211 | B2 * | 6/2010 | Marzetta | A63H 33/106 446/85 |
| 7,887,069 | B2 | 2/2011 | Bilmayer | |
| 7,942,717 | B2 * | 5/2011 | Chou | G06T 17/10 446/85 |
| 8,341,775 | B2 * | 1/2013 | Didehvar | A47K 3/38 4/558 |
| D706,362 | S * | 6/2014 | Norman | D21/487 |
| D706,877 | S * | 6/2014 | Norman | D21/487 |
| D711,972 | S * | 8/2014 | Norman | D21/487 |
| D711,973 | S * | 8/2014 | Norman | D21/487 |
| 8,800,072 | B2 * | 8/2014 | Chang | A47K 3/38 4/558 |
| D715,871 | S * | 10/2014 | Norman | D21/487 |
| 9,021,627 | B2 | 5/2015 | Parker | |
| 9,140,286 | B2 | 9/2015 | Dent | |
| 9,271,592 | B2 * | 3/2016 | Didehvar | A47H 1/142 |
| 9,556,893 | B2 | 1/2017 | Dent | |
| 9,926,960 | B2 * | 3/2018 | Stuut | F16M 11/24 |
| 10,125,466 | B2 * | 11/2018 | Desmeules | E02D 5/285 |
| 10,682,580 | B2 * | 6/2020 | Crouse | A63H 33/101 |
| 11,388,994 | B2 * | 7/2022 | Moyer | A47B 47/0008 |
| 11,592,046 | B2 * | 2/2023 | Creasy | F16B 7/025 |
| 11,773,888 | B2 | 10/2023 | Moss | |
| 11,857,098 | B2 * | 1/2024 | Berman | A47H 1/122 |
| 12,209,608 | B2 | 1/2025 | Moss | |
| 2007/0175167 | A1 | 8/2007 | Allen | |
| 2012/0187062 | A1 | 7/2012 | Sadler, III | |
| 2021/0254649 | A1 * | 8/2021 | Chen | F16B 12/40 |
| 2023/0060299 | A1 | 3/2023 | Moss | |
| 2023/0407897 | A1 | 12/2023 | Moss | |

OTHER PUBLICATIONS

John Lewis Stainless Steel Pole Connector, Dia.25mm, <https://www.johnlewis.com/john-lewis-stainless-steel-pole-connector-dia-25mm/p231617598>, publicly available at least before Aug. 25, 2021, 6 pages.

Photographs of Umbra Zen Curtain Rod product, publicly available at least before Jan. 19, 2024, 2 pages.

Screen capture from YouTube video clip entitled "Rotator Rod's ability to flip in and makes this curved shower rod is PERFECT for small bathrooms!" uploaded on Jun. 14, 2021 by user RotatorRod, 1 page. Retrieved from Internet: <https://www.youtube.com/watch?v=7HWXh5eboUI>.

Screen captures from YouTube video clip entitled "Rotator Rod—Installing the Curved Shower Rod for Small Bathrooms", uploaded on Feb. 27, 2019 by user RotatorRod, 2 pages. Retrieved from Internet: <https://www.youtube.com/watch?v=y1EB_9IEXW8>.

Screen captures from YouTube video clip entitled "RotatorRod—What's in the Box 2015", uploaded on May 7, 2015 by user RotatorRod, 2 pages. Retrieved from Internet: <https://www.youtube.com/watch?v=7FBC1dN4Euw>.

Umbra Zen Curtain Rod, <https://www.umbra.com/collections/all-window/products/zen-curtain-rod>, publicly available at least before Jan. 19, 2024, 8 pages.

* cited by examiner

ROD CONNECTOR SYSTEM AND METHODS OF USE

FIELD

This disclosure relates to connectors and, in particular, to connectors for joining rods together.

BACKGROUND

Many homeowners place curtain rods above windows to enable curtains to be drawn open or closed over the window to selectively control the amount of light entering a room from outside the home. Curtains may also be drawn closed to inhibit those outside of the home from viewing inside the home through the window. Curtain rods are also often used with showers to hang a shower curtain along an opening to a shower to prevent water from exiting the shower.

Since the curtain rods must span the width of a window or the length of a shower, the curtain rods can be very long. Even where telescoping rods are used, the length of each rod may be very long. As a result, the curtain rods are placed in long boxes for sale, storage, and transportation. Long boxes are more costly to produce, to transport, and to store in a warehouse and consume too much display space in retail stores.

Further, connections can also provide a rough transition between tubes. In many instances, curtains are suspended from the rods using loops and hooks. The loops and hooks have to slide along the rods to open and close the curtain. When there is a rough transition between the rods, the loops and hooks tend to hang up on the transitions as they slide along the rods.

DETAILED DESCRIPTION

Figure 1:
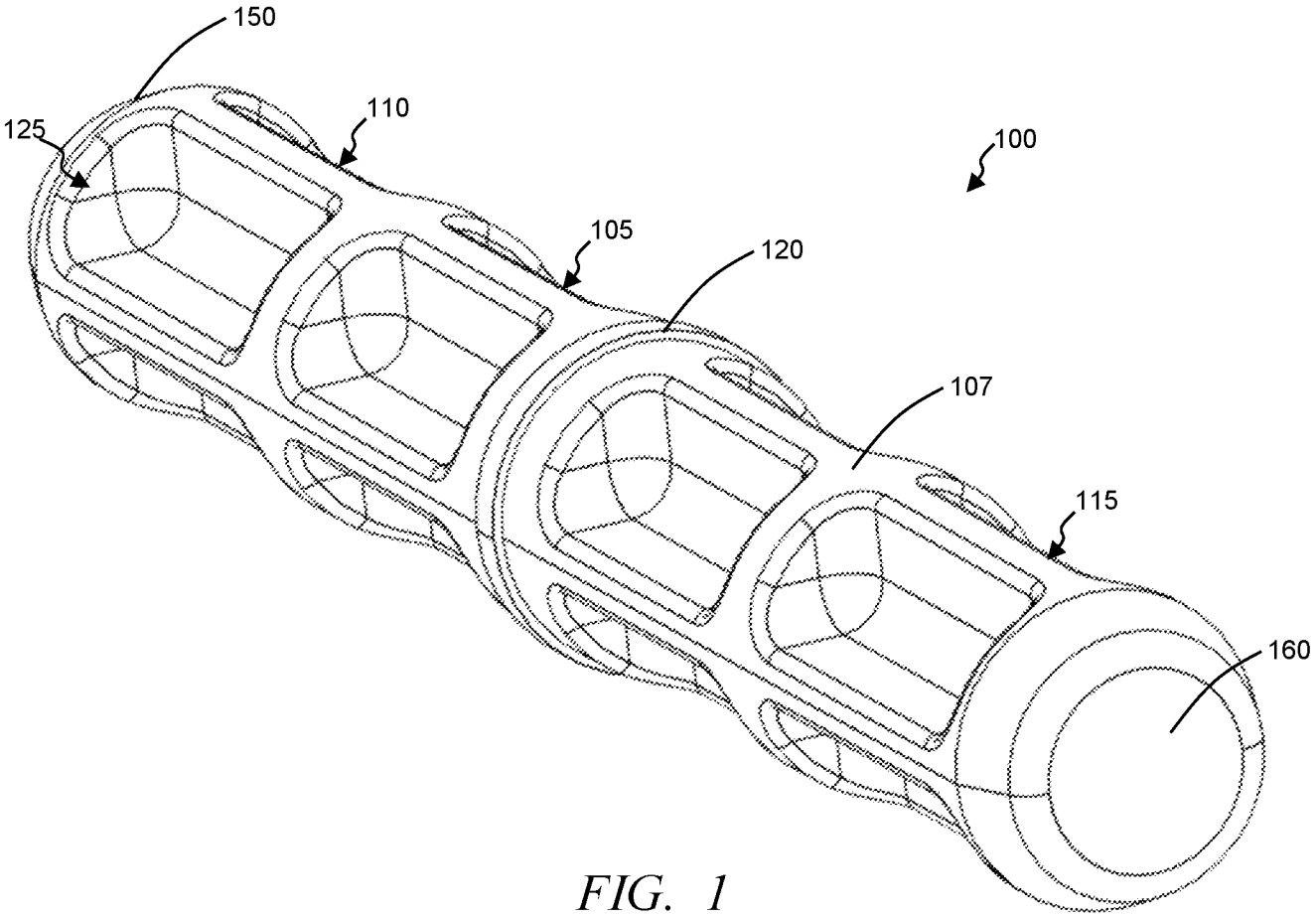
FIG. 1 is a front-side perspective view of a rod connector according to a first embodiment.
Figure 2:
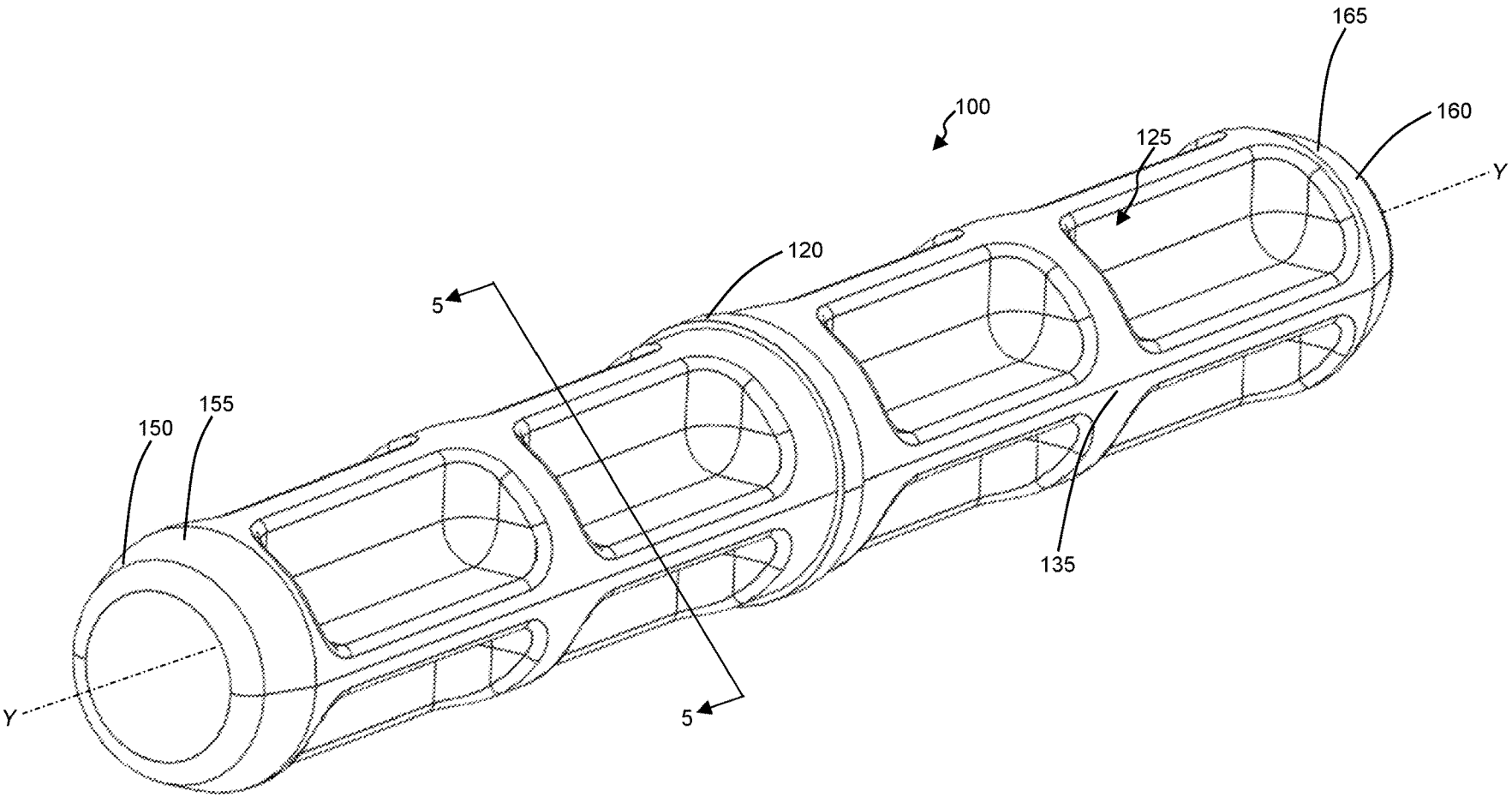
FIG. 2 is a back-side perspective view of the rod connector of FIG. 1.

A rod connector is provided for coaxially connecting two rods together. The rods may be, for example, curtain rods for supporting curtains over a window or shower rods for supporting a shower curtain. The rod connector also may be used, for example, to connect rods used to support a shower caddy, rods of a storage support, and rods of a closet pole (e.g., for hanging clothes). Overall, the rod connector is for use in any other applications to join two rods together to increase the overall combined rod length. The rod connector also provides a smooth transition from one rod to the other. The two rods may be separate when packaged enabling a box having a shorter length to be used which reduces the costs of the box and costs associated with shipping and storing the packaged rod system. The end user or installer may join the two rods together using the rod connector to provide a rod having a desired length, e.g., a length that spans the width of a window or the length of a shower.

With respect to FIGS. 1-4 and 8, a rod connector 100 is shown according to a first embodiment. The rod connector 100 has an elongate, generally cylindrical body 105 that includes a first shaft portion 110 and a second shaft portion 115 sized to be received by a first hollow rod 170 and a second hollow rod 175, respectively. The length of body 105 is generally linear or straight so that it may be received within straight rods 170, 175 or straight portions of curved rods. The rod connector 100 has a solid core (i.e., is not hollow).

The first shaft portion 110 and the second shaft portion 115 are separated by a circumferential ridge 120. Specifically, the circumferential ridge 120 projects radially outward from and about the elongate body 105 at about a midpoint or other intermediate point of the elongate body. The circumferential ridge 120 may be a continuous ridge or, in other embodiments, may be a discontinuous ridge. The circumferential ridge 120 projects from the body 105 enough for ends of the first rod 170 and the second rod 175 to contact or abut side surfaces of the circumferential ridge 120 when the rod connector 100 is received within the first rod 170 and the second rod 175. In addition, the radial extent of the circumferential ridge 120 may be selected so that the circumferential ridge 120 does not project beyond the outer perimeters of the rods 170, 175. For instance, an outer diameter of the circumferential ridge 120 may be substantially equal to an outer diameter of the rods 170, 175 so that the outer perimeters of the rods 170, 175 are at a same radial extent of the circumferential ridge 120 so that the transition between the rods 170, 175 is smooth. In other forms, the outer diameter of the circumferential ridge 120 is slightly smaller or larger than the outer diameter of the rods 170, 175, though still permitting a substantially smooth transition. This smooth transitional surface permits or facilitates curtains and/or curtain rings or hooks which support a curtain to pass from the first rod 170 to the second rod 175, and vice versa, without catching on an end of a rod or the connector 100 as the curtains/curtain rings are drawn to one side or the other of the rod connector 100. For instance, in one example, when a user grasps and drags a curtain from the first rod 170 to the second rod 175 and past the rod connector 100, the holes, rings, or hooks of the curtain easily make the transition without slowing down, getting caught, or requiring additional force or maneuvering.

The circumferential ridge 120 also ensures that the rod connector 100 is properly positioned and balanced within the rods 170, 175. That is, the circumferential ridge 120 acts as a stop so that only part of the rod connector 100 (e.g., the first shaft portion 110 or the second shaft portion 115) is inserted into a single rod, preventing the entire rod connector 100 or too much of the rod connector 100 from being inserted into one of the rods. In the illustrated embodiment, for example, the circumferential ridge 120 is centrally positioned between the generally equally sized first shaft portion 110 and the second shaft portion 115 so that one of the rods receives the first shaft portion 110 and the other of the rods receives the second shaft portion 115 and the rod connector 100 is equally weighted and balanced in the rods so that both rods are supported by the rod connector 100 with substantially equal strength. The circumferential ridge 120 also serves to support and keep the rods straight (prevent bending of the rods relative to one another) by providing a surface for the rods to abut against.

In embodiments, the radial extent of the ridge may be from about 0.20 mm to about 1.5 mm beyond the remainder of the connector 100. Generally, the radial extent of the ridge may be selected to correspond to a wall thickness of the rods, which may, for example be from about 0.20 mm to about 1.5 mm. In one approach, the radial extent of the ridge and the wall thickness of the rods may be from about 0.20 mm to about 0.50 mm. For instance, in one example, the circumferential ridge has a radial extent of about 0.35 mm so that the diameter of the rod connector 100 at the circumferential ridge is about 12.70 mm while the maximum diameter of the rest of the rod connector is about 12.00 mm. In this example, the wall thickness of the rod may also be about 0.35 mm.

In different configurations the maximum diameter of the rod connector 100 may vary for use with rods of varying diameters. For instance, in embodiments the rod connector 100 may be sized to have a friction fit connection with rods having outside diameters spanning from 10 mm to 35 mm.

In embodiments, the axial width of the ridge may be, for example, from about 1.0 mm to about 10.0 mm. In one approach, the axial width may be, for example from about 1.6 mm to about 7.2 mm. The axial width of the ridge is selected so that the ridge is durable enough to withstand the force of the rods abutting or engaging the ridge.

In some approaches, the entirety of the circumferential ridge 120 may project a uniform distance from the body 105 (i.e., having a uniform radial extent) while in other approaches the circumferential ridge 120 may have a non-uniform radial extent, for example, to define an arcuate or rounded profile of the ridge 120 along a longitudinal axis Y of the rod connector 100.

The rod connector 100 is sized so that an outer side surface 107 of the rod connector 100 (e.g., at the first and second shaft portion 110, 115), which has a curvature corresponding to an inner curvature of the rods 170, 175, can engage the inner surfaces of the rods 170, 175 in a friction fit connection. This attaches the rod connector 100 securely to the rods 170, 175. Advantageously, the rod connector 100, as well as the other rod connectors described below, do not include threading and do not require any further plugs or inserts disposed in the rods or other coupling elements to secure the rod connector to the rods.

In certain embodiments, a length l of each shaft portion 110, 115 (i.e., the length from an end of the shaft portion to the circumferential ridge 120) is proportioned relative to a maximum diameter d of each shaft portion 110, 115. For example, the length l may be larger than the maximum diameter d. In embodiments, for instance, the ratio of the length l to the maximum diameter d is greater than about 1.0. In some embodiments, the ratio is about 1.25 or more, about 1.4 or more, about 1.5 or more, or about 1.7 or more. By some approaches, a maximum ratio may be about 5.0. In embodiments, these ratios are effective to keep the rod connector 100 properly weighted to provide a stable connection with the rods. In some embodiments, for instance, as the diameter of the shaft increases, the longer the shaft becomes (i.e., more of the connector extends into the rod).

In addition, the length of each shaft portion may be selected based on the length of the rod connected to the shaft portion. Generally, the length of each shaft portion 110, 115 may increase as the length of the rod increases. In some embodiments, the shaft portions 110, 115 may be different lengths to correspond to rods of different lengths connected to each shaft portion 110, 115. In this approach, the circumferential ridge 120 may not be positioned centrally along the length of the rod connector 100, separating two equally long shaft portions 110, 115, but may be positioned to unequally distinguish one shaft portion from another shaft portion so that they have different lengths for proper weighting in rods of different lengths.

The outer side surface 107 of the rod connector may be interrupted by a plurality of voids or pockets 125. The size and amount of the pockets 125 are selected to provide an optimal amount of friction between the rod connector 100 and the rods 170, 175 while reducing the amount of material used in making the connector. For instance, since the pockets 125 define portions of the rod connector 100 which do not contact the rods 170, 175, they reduce the friction between the rod connector 100 and the rods 170, 175 to facilitate insertion and removal of the rod connector 100 from the rods 170, 175.

In some embodiments, the first shaft portion 110 and the second shaft portion 115 each have a plurality of pockets 125. The pockets 125 may be elongated and spaced about the rod connector 100. In some embodiments, the pockets may be arranged in repeating pattern, such as in groups or rows of pockets 125 spaced about the rod connector 100. For instance, the pocket may be spaced in series along an axis of the body 105. In one example the first shaft portion 110 has a first group 127 of pockets spaced about the rod connector 100 and a second group 129 of pockets spaced about the rod connector 100. The first group 127 is positioned along the first shaft portion 110 adjacent a first end 150 of the rod connector 100 while the second group 129 is positioned along the first shaft portion 110 between the first group 127 and the circumferential ridge 120. Similarly, the second shaft portion 115 has a third group 131 of pockets and a fourth group 133 of pockets, the fourth group 133 of pockets positioned along the second shaft portion 115 adjacent a second end 160 of the rod connector 100 and the third group 131 of pockets positioned along the second shaft portion 115 between the fourth group 133 and the circumferential ridge 120. In some embodiments, each group includes four pockets 125 spaced about the rod connector 100. In other forms, each group may include two, six, eight, or more pockets 125 spaced about the rod connector 100. Other patterns of pockets 125 are possible, including irregular patterns that do not repeat.

Web portions 135 of the body 105 define the pockets 125. The web portions 135 are between each of the pockets 125, between each of the pockets 125 and the circumferential ridge 120, and between each of the pockets 125 and each end 150, 160 of the rod connector 100. The web portions 135 are continuous with one another and define a single step from each pocket 125. In some embodiments, and as illustrated, the circumferential ridge 120 extends from a centrally disposed web portion. The rods 170, 175 engage the outer side surface 107 of the rod connector 100 at the connecting web portions 135 which define a face or surface that corresponds to the radial curvature of the rods.

The amount and size of pockets 125 and web portions 135 are selected so that there is sufficient frictional contact between the rod connector and the rods to keep the components attached during use but not so much frictional contact that insertion and removal of the rod connector from the rods is too difficult. In addition, the amount of clearance between the outer diameter of the first and second shaft portions 110, 115 and the inner diameter of the rods is also selected to optimize friction. These same principles also apply equally to the rod connector embodiments (e.g., rod connector 200, 300, 400) described below.

In the illustrated embodiment, the first shaft portion 110 has four longitudinal connecting web portions 135*a* extending between each of the four pockets 125 in each group 127, 129 from the first group 127 to the second group 129. In addition, the first shaft portion 110 includes at least one circumferential connecting web portion 135*b* transverse to the longitudinal connecting web portions 135*a* and between the first group 127 and the second group 129. The second shaft portion 115 similarly has four longitudinal connecting web portions 135*a* extending between each of the four pockets 125 in each group 131, 133 from the third group 131 to the fourth group 133. In addition, the second shaft portion 115 includes at least one circumferential connecting web portion 135*b* transverse to the longitudinal connecting web portions 135*a* and between the third group 131 and the second group 133. There is a single discrete connecting web portion between each of pockets so that each connecting web portion defines a single step from each side of each pocket.

In some embodiments, a total area of the pockets 125 (i.e., defined as the total outermost area of the pockets 125 adjacent the outer side surface 107) may be proportioned relative to the total area of the outer side surface 107 defined by the first and second shaft portion 110, 115. For instance, in embodiments, a ratio of the area of the pockets 125 to an area of the outer side surface 107 may be at least about 0.5, at least about 0.6, at least about 0.7, at least about 1, at least about 1.2, at least about 1.5, or at least about 2.0. In some approaches, a maximum ratio of the area of the pockets 125 to an area of the outer side surface 107 may be about 10. In one approach, the ratio may be about 0.6 to about 5.0.

In some approaches, the pockets 125 comprise at least 20%, at least 30%, at least 40%, at least 50%, or at least 60% of the area of the outer side surface 107 of the rod connector 100. In these approaches, or other exemplary approaches, a maximum amount may be about 80%.

Figure 5:
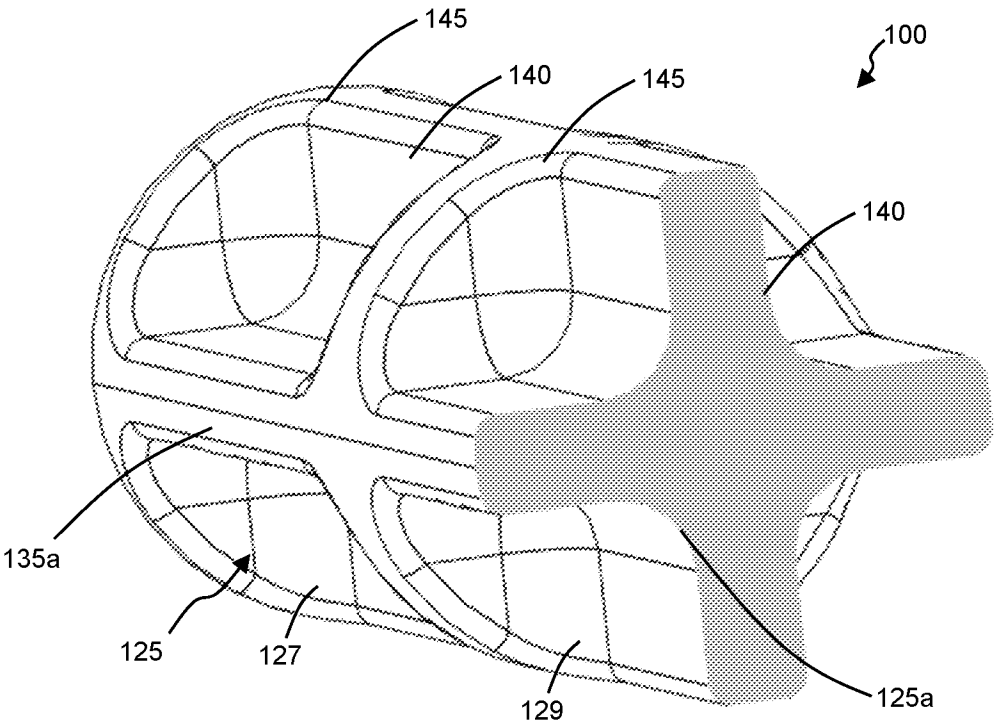
FIG. 5 is a cross-sectional view of the rod connector of FIG. 1 taken along line 5-5 of FIG. 1.

In embodiments, an outermost profile of each pocket 125 is generally rectangular and may have rounded corners. Other profiles of the pocket 125 are also possible (e.g., oval, circular, etc.). With reference to FIG. 5, in some embodiments, sides of each pocket 125 may slope or taper down to a vertex 125*a* (e.g., a rounded vertex) defining a generally triangular cross-section (linear legs and an arcuate hypotenuse) of the pocket 125. In this configuration, the pocket 125 and longitudinal connecting web portions 135*a* define cross-shaped cross-sectional portions 140 of the body 105 of the rod connector at the position of the pocket 125. Disc-shaped cross-sectional portions 145 of the body 105 are defined where the circumferential connecting web portions 135*b* are positioned, at or adjacent the circumferential ridge 120, and at the ends 150, 160 of the rod connector 100. Thus, the rod connector 100 may have a varied cross-section with alternating disc-shaped 145 and cross-shaped 140 portions.

Figure 3:
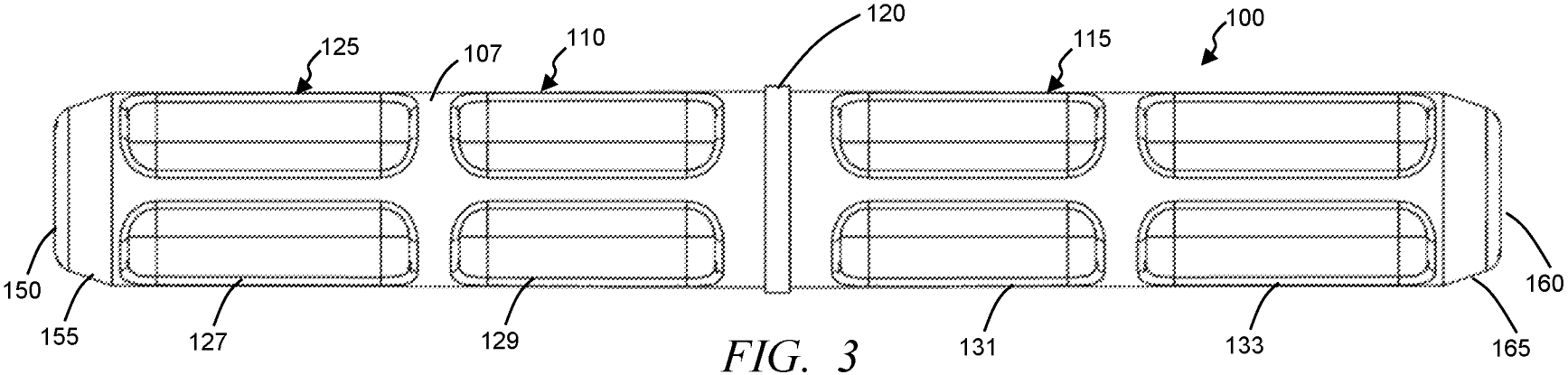
FIG. 3 is a front-side elevation view of the rod connector of FIG. 1.
Figure 4:
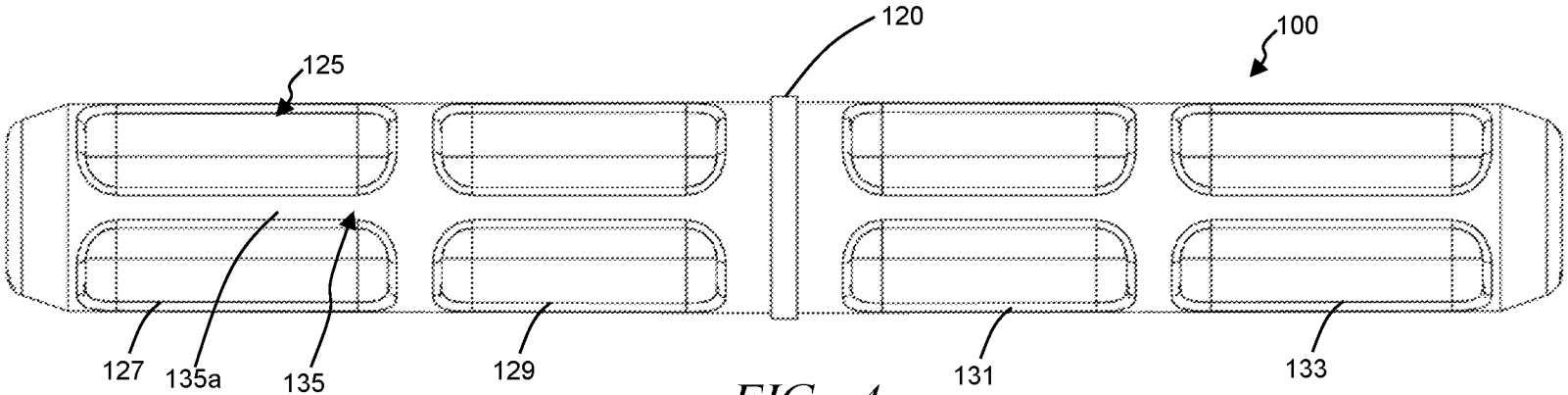
FIG. 4 is a back-side elevation view of the rod connector of FIG. 1.
Figure 7:
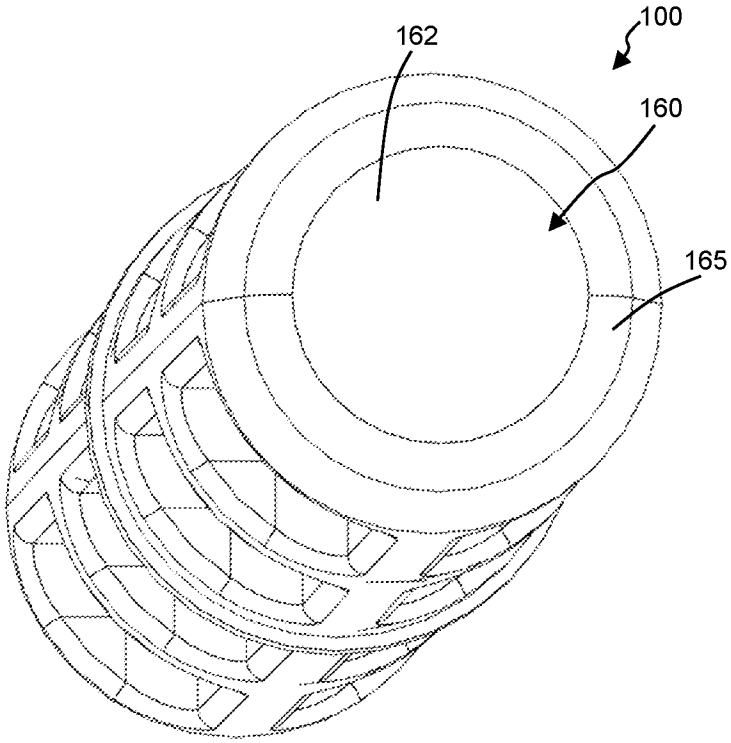
FIG. 7 is a second-end perspective view of the rod connector of FIG. 1.
Figure 6:
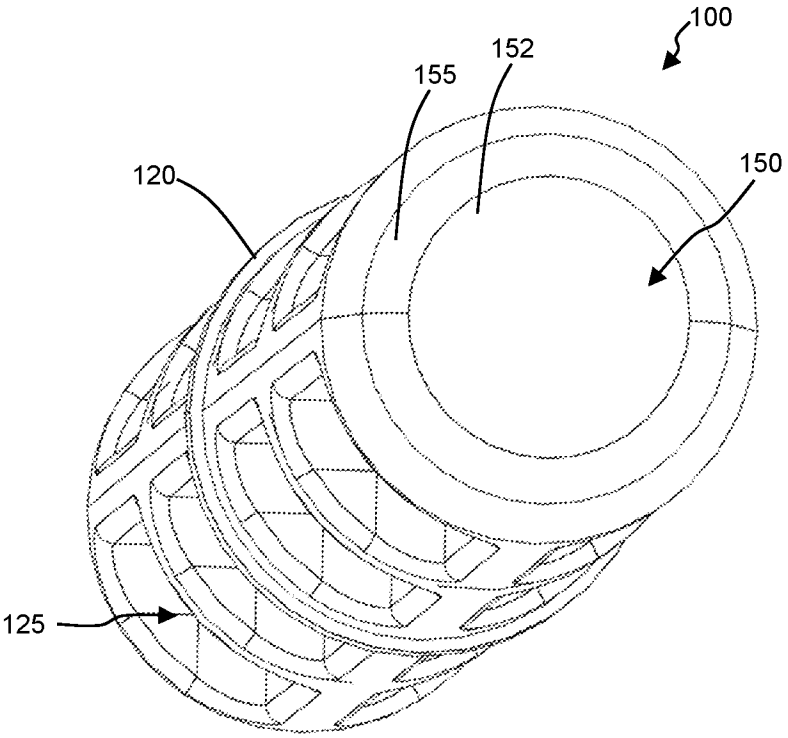
FIG. 6 is a first-end perspective view of the rod connector of FIG. 1.

With reference to FIGS. 3 and 6-7, the rod connector 100 may be tapered at the first end 150 and the second end 160 to facilitate insertion of the rod connector 100 into the rods 170, 175. Specifically, respective tapered portions 155, 165 of the body 105 adjacent each end 150, 160, taper radially inward so each end 150, 160 terminates in a respective face 152, 162 having a reduced diameter relative to the widest diameter of the body 105.

Figure 8:
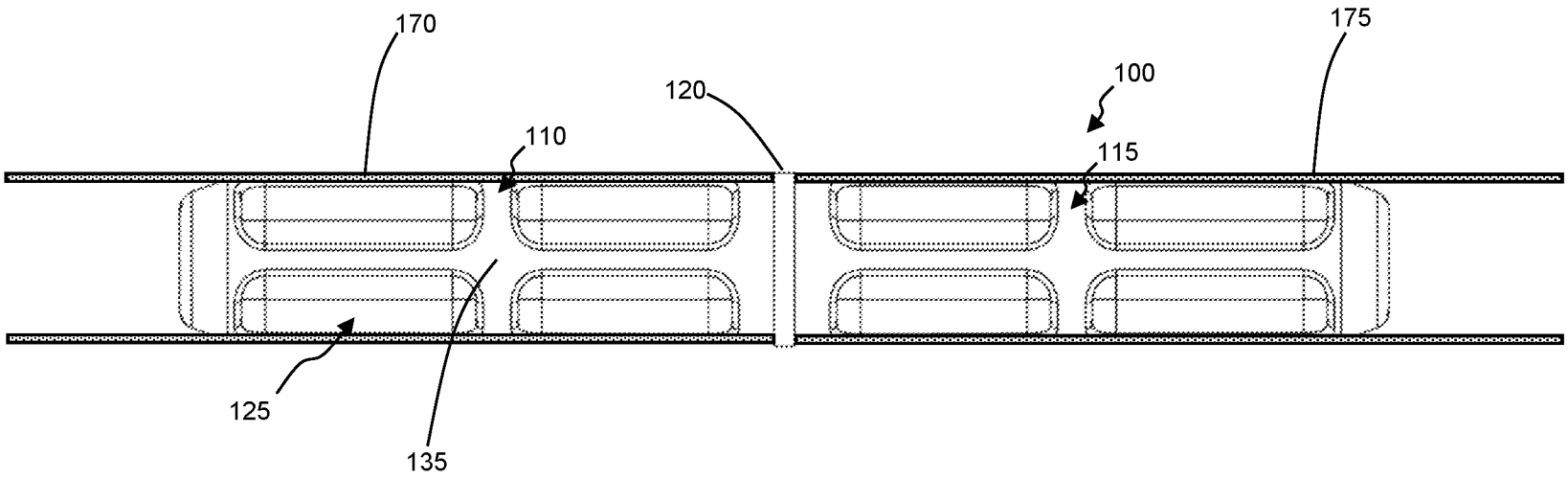
FIG. 8 is a partial cutaway view of a rod showing the connector of FIG. 1 connecting two rods.
Figure 9:
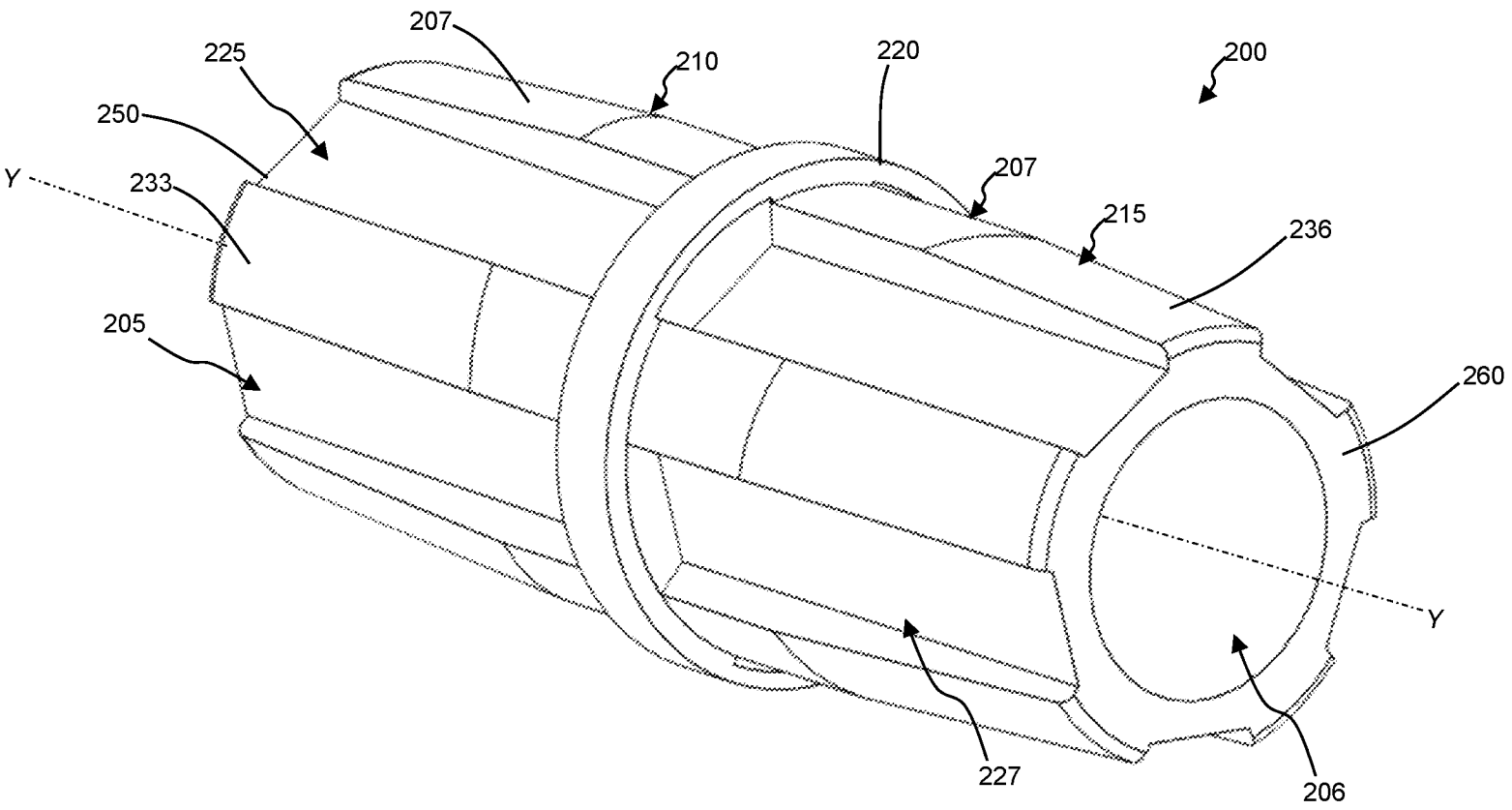
FIG. 9 is a front-side perspective view of a rod connector according to a second embodiment.
Figure 10:
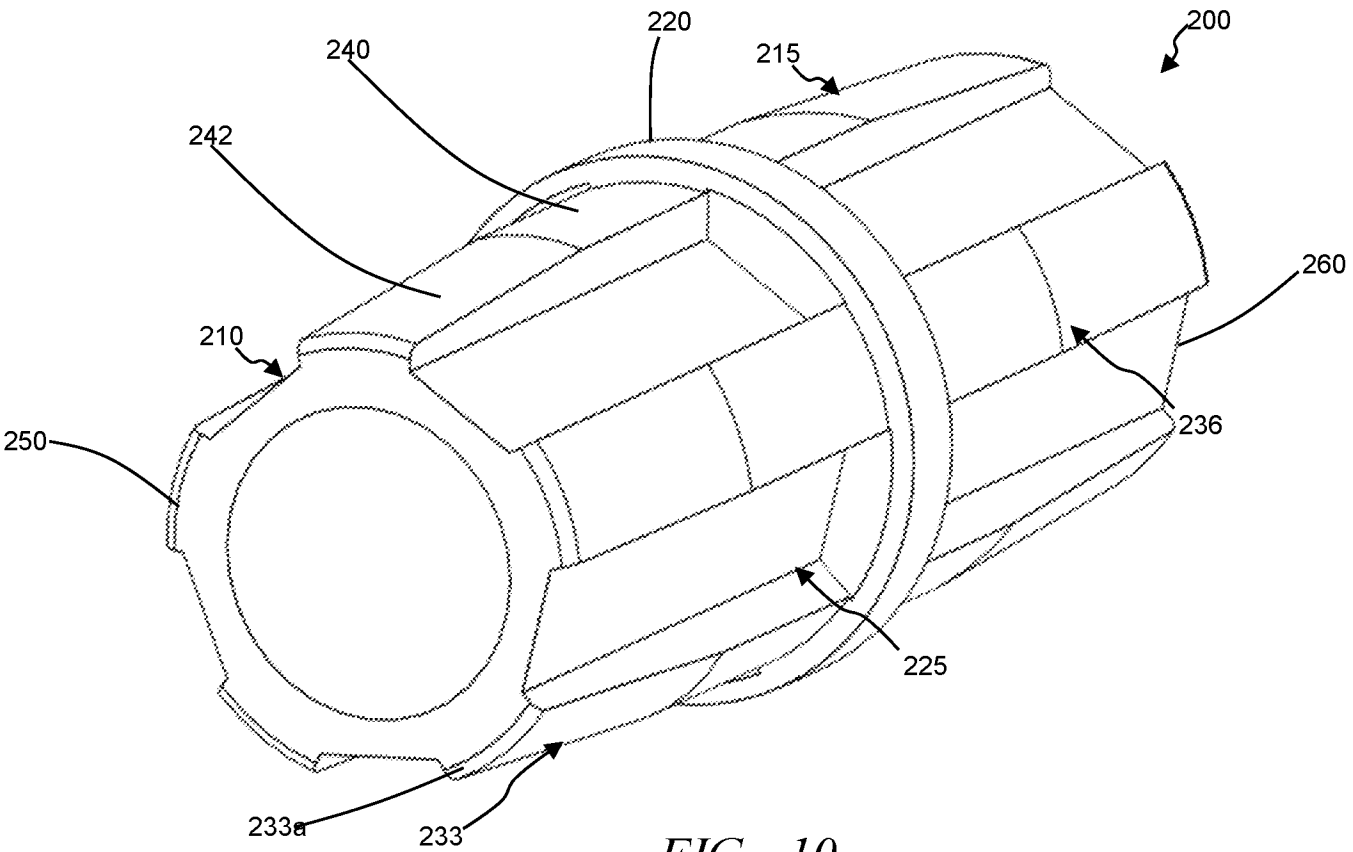
FIG. 10 is a back-side perspective view of the rod connector of FIG. 9.
Figure 11:
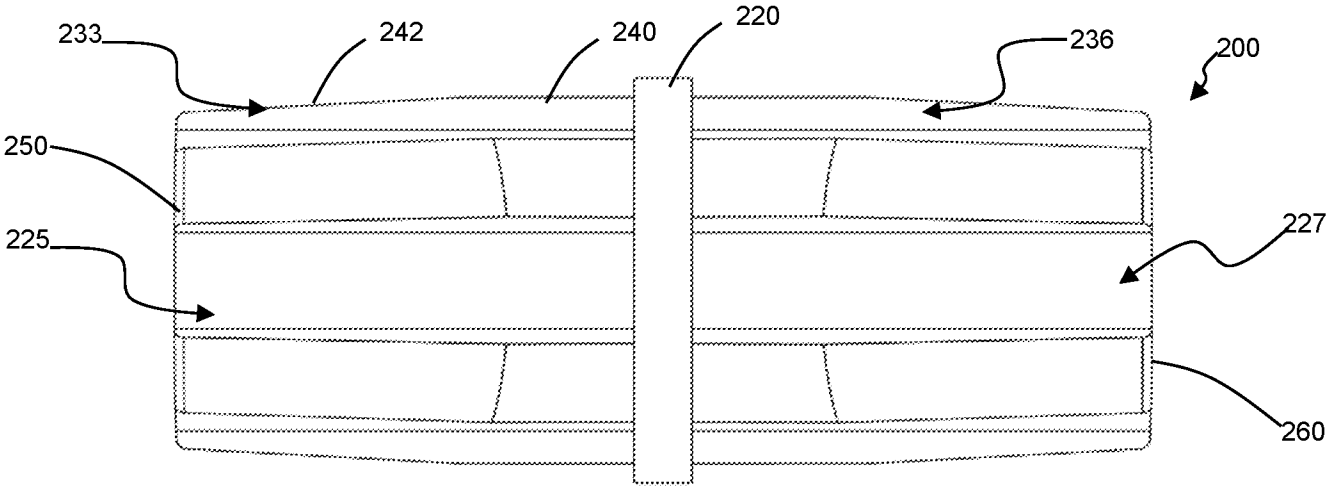
FIG. 11 is a front-side elevation view of the rod connector of FIG. 9.
Figure 12:
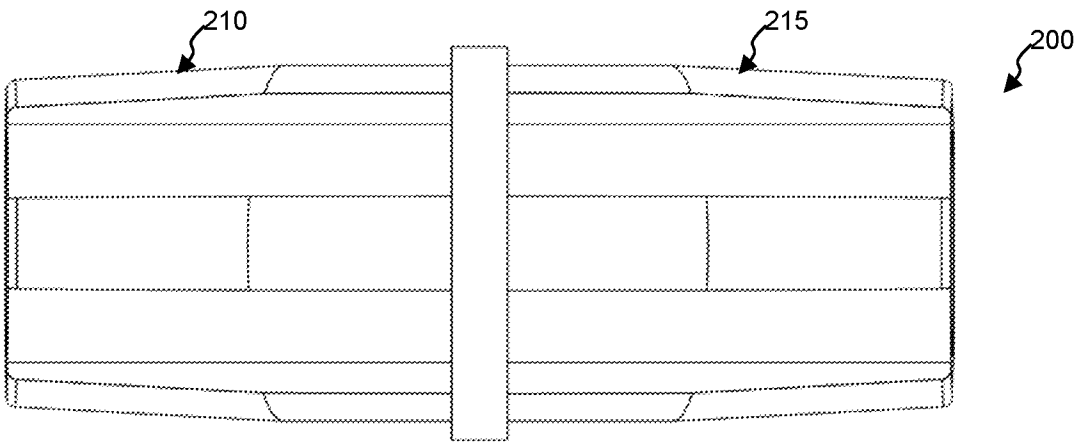
FIG. 12 is a back-side elevation view of the rod connector of FIG. 9.

With respect to FIG. 8, the rod connector 100 is shown attaching the two rods 170, 175 coaxially to one another. The first shaft portion 110 is inserted into the first rod 170 and the second shaft portion 115 is inserted into the second rod 175 until the first rod 170 and the second rod 175 abut the circumferential ridge 120. Thus, the circumferential ridge 120 is the only portion of the rod connector 100 that is externally visible when installed in the rods 170, 175. The rods 170, 175 are secured to the first shaft portion 110 and the second shaft portion 115 via a friction fit connection with the connecting web portions 135 of the rod connector. The outer diameter of the rods 170, 175 may be substantially level, if not level, with the outer diameter of the circumferential ridge 120. In other forms, the circumferential ridge 120 may have a slightly larger or smaller diameter than the outer diameter of the rods 170, 175 as noted above. For instance, a slightly larger diameter (and/or an increased axial width of the ridge) may make it possible to grasp the circumferential ridge 120 for leverage when pulling the rods 170, 175 off the connector 100 when disconnecting. In any case, there is a substantially smooth transitional surface from the first rod 170 to the second rod 175 when the rods 170, 175 are connected by the rod connector 100 to permit curtains or curtain rings to pass over the connection interface of the rods 170, 175 with ease.

To disconnect the rods 170, 175, the externally visible circumferential ridge 120 of the connector may be located and the rods 170, 175 are pulled away from one another and off the rod connector 100.

By use of the rod connector 100, or any of the additional rod connector embodiments described below, a curtain rod system may include two shorter rods that are easily joined together by the rod connector 100 to form a longer rod upon assembly by the installer or end user. The curtain rod system with shorter rods may be contained, transported, stored, and displayed in a smaller box which reduces the costs of the box, the cost to transport the system, the cost to store the system, and the cost to display the system, all without compromising the functionality and utility of the curtain rod system.

With reference to FIGS. 9-15, a rod connector 200 is shown according to a second embodiment. While the rod connector 100 is adapted for use with linear rods 170, 175, the rod connector 200 may be adapted for use with curved rods 270, 275 having a longitudinal or axial curvature.

The rod connector 200 has an elongate, generally cylindrical body 205 that includes a first shaft portion 210 and a second shaft portion 215 sized to be received in ends of a first curved rod 270 and a second curved rod 275, respectively. As illustrated, the body 205 may have an annular ring-like cross-section that defines a central passage 206. In other embodiments, the body 205 may have a solid core. The first shaft portion 210 and second shaft portion 215 together define an outer side surface 210 of the body 205.

The first shaft portion 210 and the second shaft portion 215 are separated by a circumferential ridge 220. Specifically, the circumferential ridge 220 projects radially outward from and about the body 205 at a midpoint or other intermediate point of the body 205. The circumferential ridge 220 may be a continuous ridge or, in other embodiments, may be a discontinuous ridge. The circumferential ridge 220 projects from the body 205 enough so that ends of the first rod 270 and the second rod 275 contact or abut side surfaces of the circumferential ridge 220 when the rod connector 200 is inserted into the first rod 270 and the second rod 275. In addition, the radial extent of the circumferential ridge 220 may be selected so that the circumferential ridge 220 does not project much farther than the outer perimeters of the rods 270, 275. For instance, an outer diameter of the circumferential ridge 220 may be substantially equal, if not equal to, to an outer diameter of the rods 270, 275 so that the outer perimeters of the rods 270, 275 are substantially level with a radially outermost surface of the circumferential ridge 220 so that the transition between the rods 270, 275 is smooth. In other forms, the outer diameter of the circumferential ridge 220 is slightly smaller or larger than the outer diameter of the rods 270, 275, though still permitting a substantially smooth transition. This smooth transitional surface permits or facilitates curtains and/or curtain rings or hooks which support a curtain to pass from the first rod 270 to the second rod 275, and vice versa, without catching on an end of a rod or the connector 200 as the curtains/curtain rings are drawn to one side or the other of the length of the rods 270, 275. In addition, as discussed for rod connector 100, the circumferential ridge 220 also ensures that the rod connector 200 is properly positioned and balanced within the rods 270, 275. That is, the circumferential ridge 220 acts as a stop so that only part of the rod connector 200 (e.g., the first shaft portion 210 or the second shaft portion 215) is inserted into a single rod, preventing the entire rod connector 100 or too much of the rod connector 100 from being inserted into one of the rods. The circumferential ridge 220 also serves to support and keep the rods properly positioned relative to one another (prevent bending of the rods relative to one another) by providing a surface for the rods to abut against.

In some embodiments, the radial extent of the circumferential ridge 220 may be defined by an amount the circumferential ridge 220 projects beyond a radially outermost portion of the outer side surface 207 of the body 205 of the rod connector 200. Like for rod connector 100, in embodiments, this radial extent of the ridge 220 may be selected to generally correspond to a wall thickness of the rods and may, for example, be from about 0.20 mm to about 1.5 mm. In one approach, the radial extent of the ridge and the wall thickness of the rods may be from about 0.20 mm to about 0.50 mm.

In different configurations the maximum diameter of the rod connector 200 may vary for use with rods of varying diameters. For instance, in embodiments the rod connector 200 may be sized to have a friction fit connection with rods having outside diameters spanning from 10 mm to 35 mm.

In embodiments, the axial width of the ridge 220 may be the same as discussed above with respect to rod connector 100. In one approach, the axial width may be, for example, from about 4.0 mm to about 10.0 mm.

In some approaches, the entirety of the circumferential ridge 220 may project a uniform distance from the body 205 (i.e., having a uniform radial extent) while in other approaches the circumferential ridge 220 may have a non-uniform radial extent, for example, to define an arcuate or rounded profile of the ridge 220 along a longitudinal axis Y of the rod connector 200.

In certain embodiments, a length l of each shaft portion 210, 215 (i.e., the length from an end of the shaft portion to the circumferential ridge 220) is proportioned relative to a maximum diameter d of each shaft portion 210, 215. For example, the length l may be larger than the maximum diameter d. In embodiments, for instance, the ratio of the length l to the maximum diameter d is greater than about 1.0. In some embodiments, the ratio is about 1.25 or more, about 1.4 or more, about 1.5 or more, or about 1.7 or more. By some approaches, a maximum ratio may be about 5.0. In embodiments, these ratios are effective to keep the rod connector 200 properly weighted to provide a stable connection with the rods. In some embodiments, for instance, as the diameter of the shaft increases, the longer the shaft becomes (i.e., more of the connector extends into the rod).

In addition, the length of each shaft portion may be selected based on the length of the rod connected to the shaft portion. Generally, the length of each shaft portion 210, 215 may increase as the length of the rod increases. In some embodiments, the shaft portions 210, 215 may be different lengths to correspond to rods of different lengths connected to each shaft portion 210, 215. In this approach, the circumferential ridge 220 may not be positioned centrally along the length of the rod connector 200, separating two equally long shaft portions 210, 215, but may be positioned to unequally distinguish one shaft portion from another shaft portion so that they have different lengths for proper weighting in rods of different lengths.

A plurality of longitudinal ridges or ribs 233, 236 project radially from the body 205 along the length of the first shaft portion 210 and the second shaft portion 215. Specifically, longitudinal ridges 233 are substantially equally spaced about the first shaft portion 210 and extend lengthwise from a first end 250 of the body to the circumferential ridge 220. Similarly, longitudinal ridges 236 are spaced substantially equally about the second shaft portion 215 and extend lengthwise from a second end 260 of the body to the circumferential ridge 220. The longitudinal ridges 233, 236 each define a widened face that defines at least in part the outer side surface 207 of the rod connector 200 and have two curvatures that correspond to an inner radial curvature of the rods 270, 275 and the longitudinal curvature of the rods 270, 275 so that inner surfaces of the rods 270, 275 engage the longitudinal ridges 233, 236 in a friction fit connection. There is a single discrete ridge between each of the voids or grooves 225, 227 described below so that each ridge defines a single step from each side of each void or groove 225, 227.

The longitudinal ridges 233 define a first plurality of voids or grooves 225 therebetween on the first shaft portion 210 while the longitudinal ridges 236 define a second plurality of elongate grooves 227 therebetween on the second shaft portion 215. For instance, in one example there may be five longitudinal ridges and five elongate grooves defined between the five longitudinal recesses on each of the first shaft portion 210 and the second shaft portion 215. In other approaches, there may be three, four, six, seven, eight, or more of the longitudinal ridges and corresponding grooves.

The radially outermost surface of the longitudinal ridges 233, 236 may have a generally rectangular profile. The grooves 225, 227 may also be correspondingly rectangular and may have a length corresponding to the length of the longitudinal ridges 233, 236. In some forms, the grooves 225, 227 also may have a width generally corresponding to the width of the longitudinal ridges 233, 236. In other approaches, the longitudinal ridges 233, 236 may be wider or narrower than a corresponding width of the grooves 225, 227. The sizes and amounts of the longitudinal ridges 233, 236 and grooves 225, 227 may be selected to provide an optimal amount of friction between the rod connector 200 and the rods 270, 275 and reduce the material costs. For instance, since the grooves 225, 227 do not contact the rods 270, 275, they reduce the frictional engagement between the rod connector 200 and the rods 270, 275 to facilitate insertion and removal of the rod connector 200 from the rods 270, 275.

In some embodiments, a total outermost area of the grooves 225, 227 at the outer side surface 207 may be proportioned relative to the total area of the longitudinal ridges 233, 236. For instance, in embodiments, a ratio of the area of the grooves 225, 227 to an area of the longitudinal ridges 233, 236 may be at least about 0.5, at least about 0.6, at least about 0.7, at least about 1, at least about 1.2, at least about 1.5, or at least about 2.0. In some approaches, a maximum ratio of the area of the grooves 225, 227 to an area of the longitudinal ridges 233, 236 may be about 10. In one approach, the ratio may be about 0.6 to about 5.0. In an exemplary approach, the ratio may about 0.5 to about 3.0.

In some approaches, the grooves 225, 227 comprise at least 20%, at least 30%, at least 40%, at least 50%, or at least 60% of what would make up the outer side surface 207 of the rod connector 200. In these approaches, or other exemplary approaches, a maximum amount may be about 80%. In one approach, the maximum is about 70%. The grooves 225, 227 also reduce the amount of material in the connector 200 which reduces the cost of the connector 200.

The longitudinal ridges 233, 236 may each have a first portion 240 and a tapered second portion 242. The first portions 240 are adjacent the circumferential ridge 220 and may be contiguous therewith, with the circumferential ridge 220 having a radial extent (i.e., the distance the portion radially projects from the body 205) greater than that of the first portions 240. In some embodiments, the radially outermost surface 207 of at least some of the ridges 233, 236 at the first portion 240 is slightly curved along the longitudinal axis Y of the connector 200 to correspond to a curvature along the length of the curved rods 270, 275 when the rod connector 200 is inserted therein. For instance, the first portions 240 of at least some of the ridges 233, 236 may slightly curve or slope lengthwise along the rod connector 200 from the circumferential ridge 220. This curvature is not visible in the figures. In some cases, the curvature may be so slight at the area of connection between the rods 270, 275 that the rod connector 200 may appear substantially linear. The slight curvature of the first portions 240 of each of the longitudinal ridges 233, 236 permits a friction fit with the curved rods 270, 275 to secure the connector 200 to the rods 270, 275.

Figure 15:
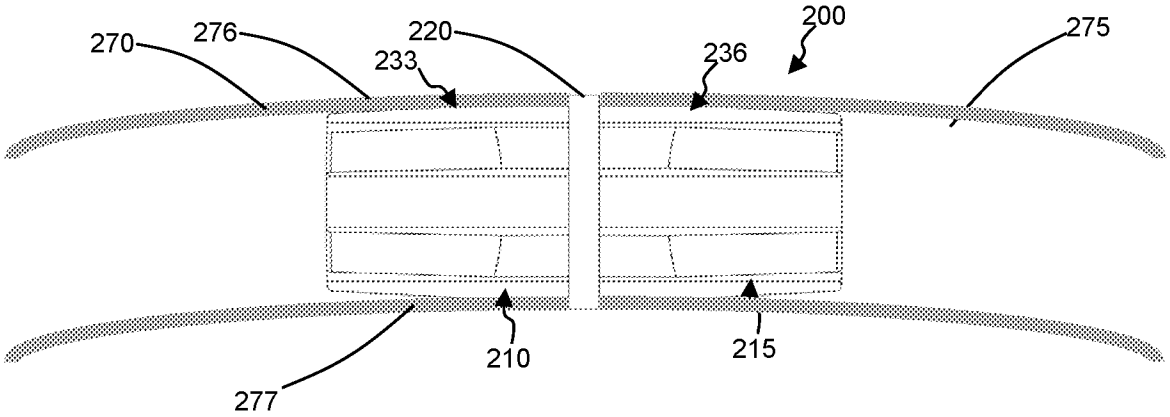
FIG. 15 is a partial cutaway view of a rod showing the connector of FIG. 9 connecting two rods.

In one example, at least one first longitudinal ridge 233 on the first shaft portion 210 and at least one second longitudinal ridge 236 on the second shaft portion 215 that is longitudinally aligned with the first longitudinal ridge 233 may symmetrically curve radially inwardly to correspond to an outer curve 276 of the rods 270, 275 (FIG. 15). In addition, at least one third longitudinal ridge 233 on the first shaft portion 210 and at least one fourth longitudinal ridge 236 on the second shaft portion 215 that is longitudinally aligned with the second longitudinal ridge 233 may symmetrically curve radially outwardly to correspond to an inner curve 277 of the rods 270, 275 (FIG. 15).

Each ridge 233, 236 may also have a tapered second portion 242. The second portion 242 may extend from the first portion 240 to a corresponding respective end 250, 260 of the body 205 and have a radial extent that gradually tapers radially inward so that a radial extent of the second portion 242 at the corresponding end 250, 260 is less than a radial extent of the second portion 242 adjacent the first portion 240. The second portion 242 may have an angled or curved outer surface along its length to define the taper.

The second tapered portions 242 of the longitudinal ridges 233, 236 spaced about the body 205 provide a gradually decreasing diameter of the body 205 of the rod connector 200 from the beginning of the second tapered portions 242 (adjacent the first portion 240) on each of the first shaft portion 210 and the second shaft portion 215 and towards the respective ends 250, 260 of the rod connector 200. The second tapered portions 242 facilitate insertion of the connector 240 into the rods.

The circumferential ridge 220 projects farther radially outwardly than the longitudinal ridges 233, 236. In this manner, the inner surfaces of the rods 270, 275 engage the longitudinal ridges 233, 236 while the terminal ends of the rods 270, 275 abut the circumferential ridge 220 when the rod connector 200 is inserted into the rods 270, 275.

Figure 14:
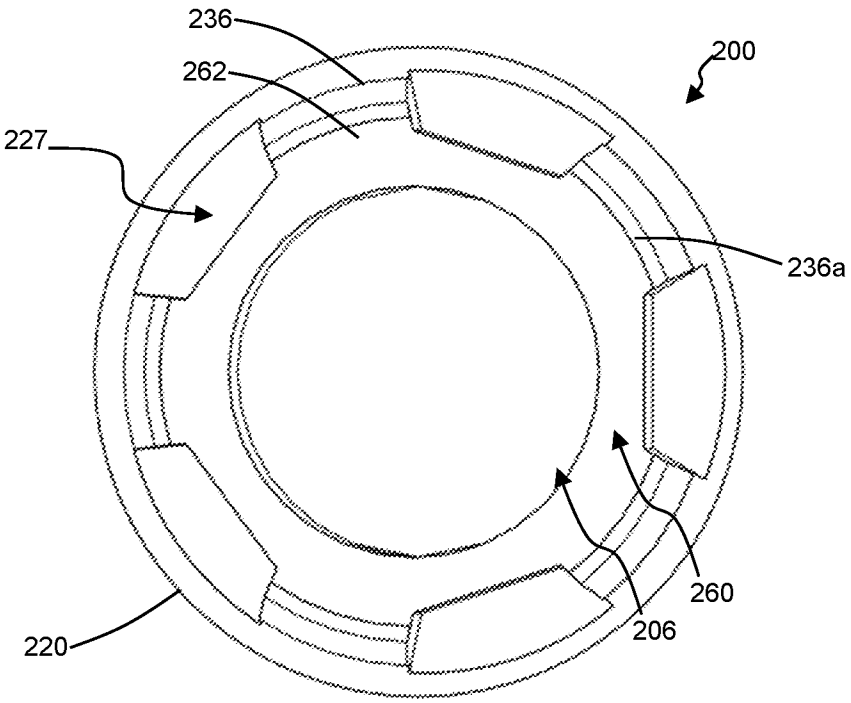
FIG. 14 is a second-end elevation view of the rod connector of FIG. 9.
Figure 13:
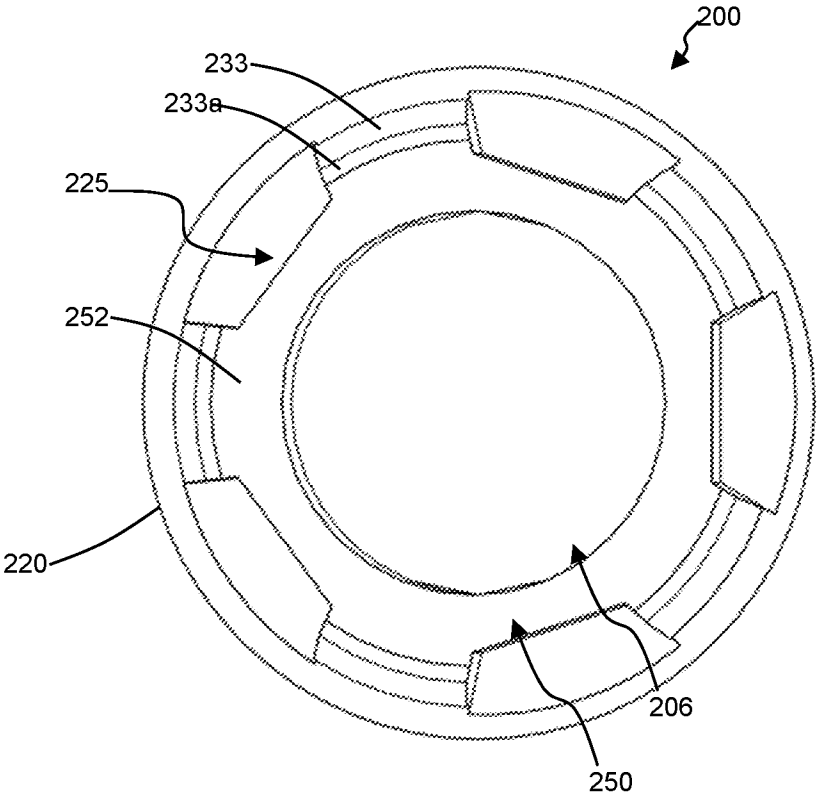
FIG. 13 is a first-end elevation view of the rod connector of FIG. 9.

As shown in FIGS. 13 and 14, each end 250, 260 of the rod connector 200 may have a respective annular face 252, 262. The tapered second portions 242 of the longitudinal ridges 233, 236 define radially projecting face portions 233*a*, 236*a* that project radially from the annular faces 252, 262. The diameter of the ends 250, 260, defined in part by the radially projecting face portions 233*a*, 236*a*, is smaller than the diameter of the rod connector 200 at the first portions 240 of the longitudinal ridges 233, 236.

With respect to FIG. 15, the rod connector 200 is shown attaching the two curved rods 270, 275 to one another. The first shaft portion 210 is inserted into the first rod 270 and the second shaft portion 215 is inserted into the second rod 275 until the first rod 270 and the second rod 275 abut the circumferential ridge 220. Thus, the circumferential ridge 220 is the only portion of the rod connector 100 that is externally visible when installed in the rods 270, 275. The rods 270, 275 are secured to the first shaft portion 210 and the second shaft portion 215 via a friction fit connection with the first portions 240 of the longitudinal ridges 233, 236.

In certain approaches, the first portions 240 of the longitudinal ridges 233, 236 may be substantially linear lengthwise along the connector 200 so that the connector 200 is configured for a friction fit with linear rods.

As illustrated, the outer diameter of the rods 270, 275 may be substantially level with the outer diameter of the circumferential ridge 220. In other forms, the circumferential ridge 220 may have a slightly larger or smaller diameter than the outer diameter of the rods 270, 275 as noted above. For instance, a slightly larger diameter (and/or an increased axial width of the ridge) may make it easier to grasp the circumferential ridge 220 for leverage when pulling the rods 270, 275 off the connector 200 when disconnecting. In any case, there is a substantially smooth transitional surface from the first rod 270 to the second rod 275 when the rods 270, 275 are connected by the rod connector 200 to permit curtains or curtain rings to pass over the connection interface of the rods 270, 275 with ease.

To disconnect the rods 270, 275, the externally visible circumferential ridge 220 of the connector may be located and the rods 270, 275 are pulled away from each other and off the rod connector 200.

With reference to FIGS. 16-23, a rod connector 300 is shown according to a third embodiment. As illustrated, the rod connector 300 is adapted for use with curved rods, though in other configurations may be adapted for use with linear rods.

The rod connector 300 has an elongate, generally cylindrical body 305 that includes a first shaft portion 310 and a second shaft portion 315 sized to be received in ends of a first curved rod 370 and a second curved rod 375 (FIG. 24), respectively. As illustrated, the body 305 may be annular and define a central passage 306. In other embodiments, the body 205 may have a solid core. The first shaft portion 310 and the second shaft portion 315 define an outer side surface 307 of the body 305.

Figure 24:
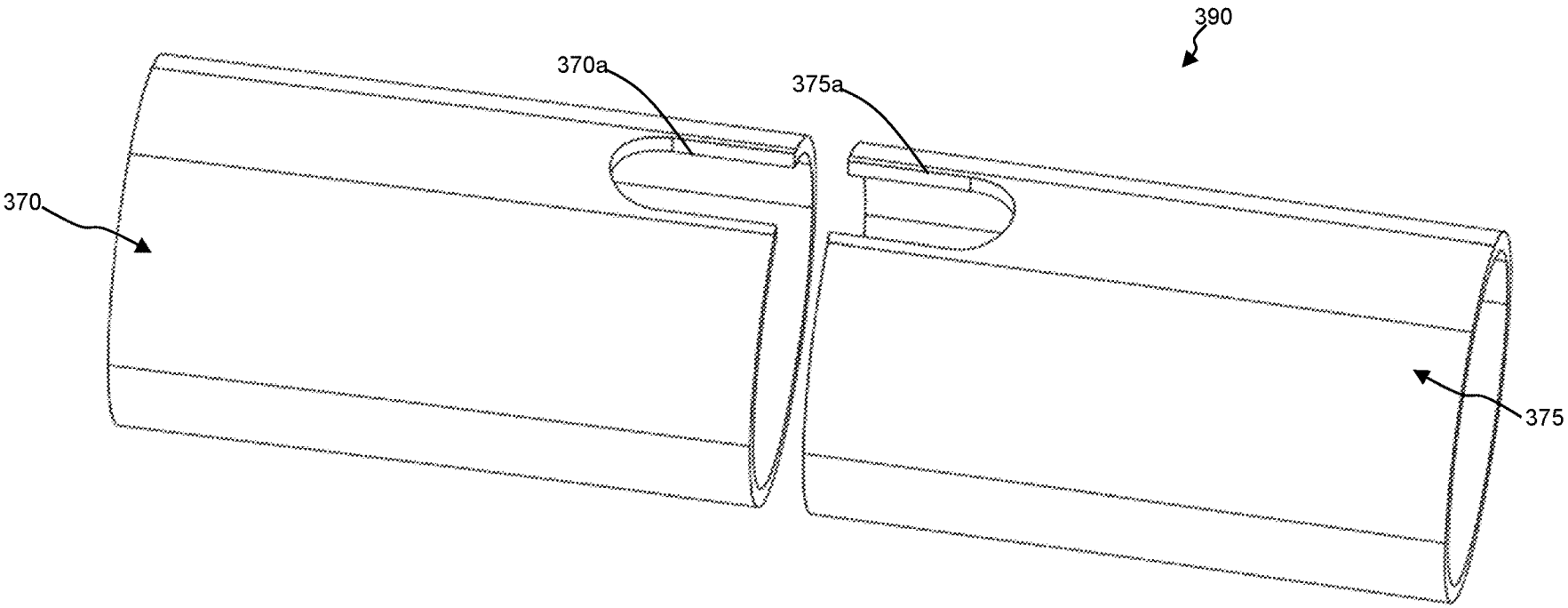
FIG. 24 is a top-side perspective view of a rod assembly for use with the rod connector of FIG. 16.
Figure 25:
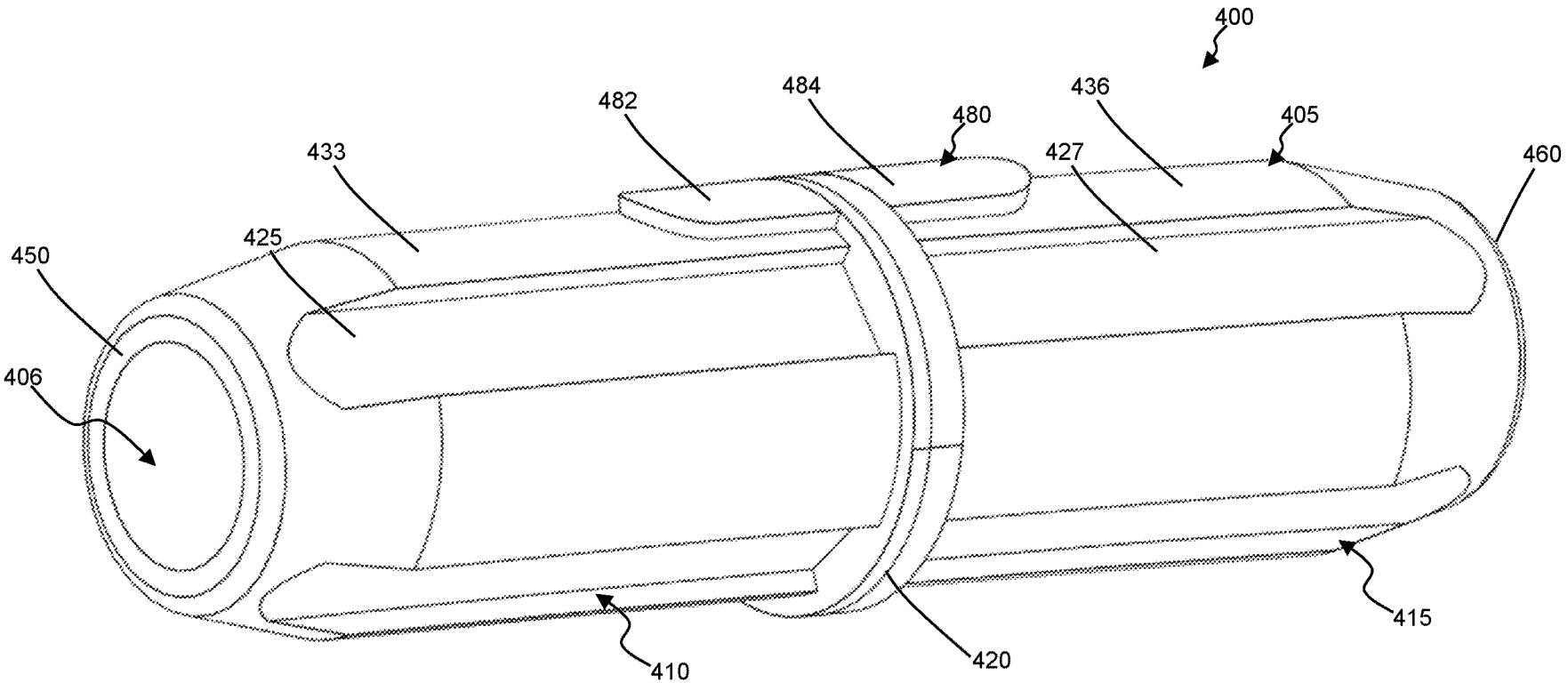
FIG. 25 is a top-side perspective view of a rod connector according to a fourth embodiment.
Figure 26:
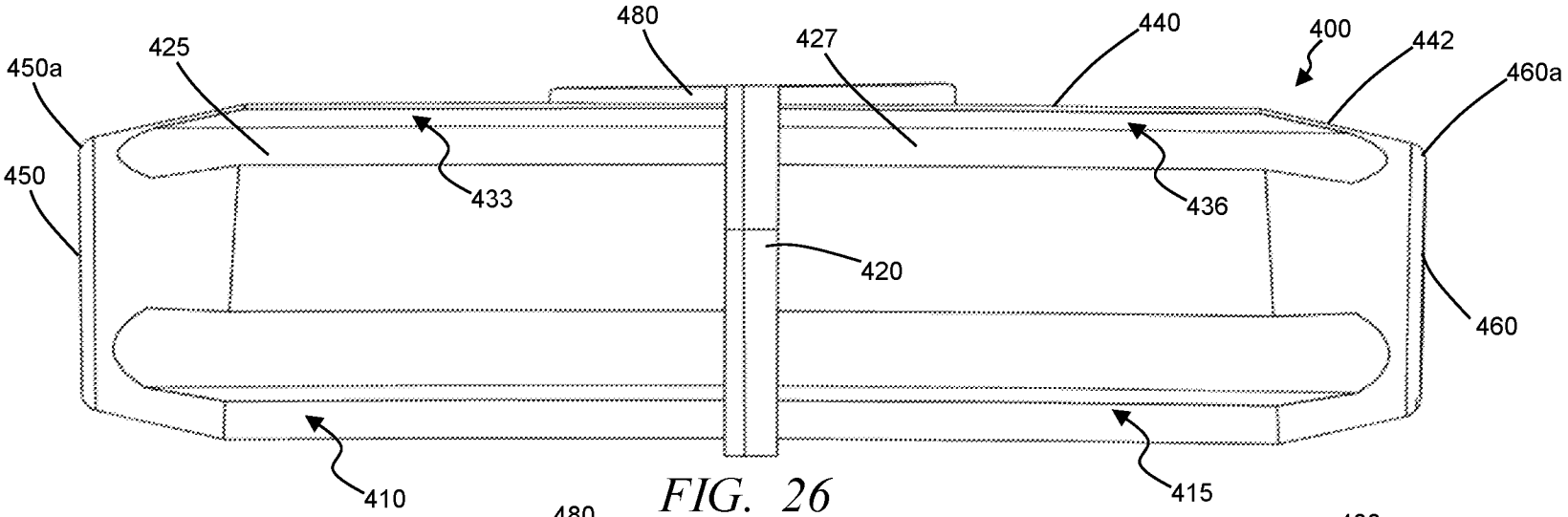
FIG. 26 is a top plan view of the rod connector of FIG. 25.
Figure 27:
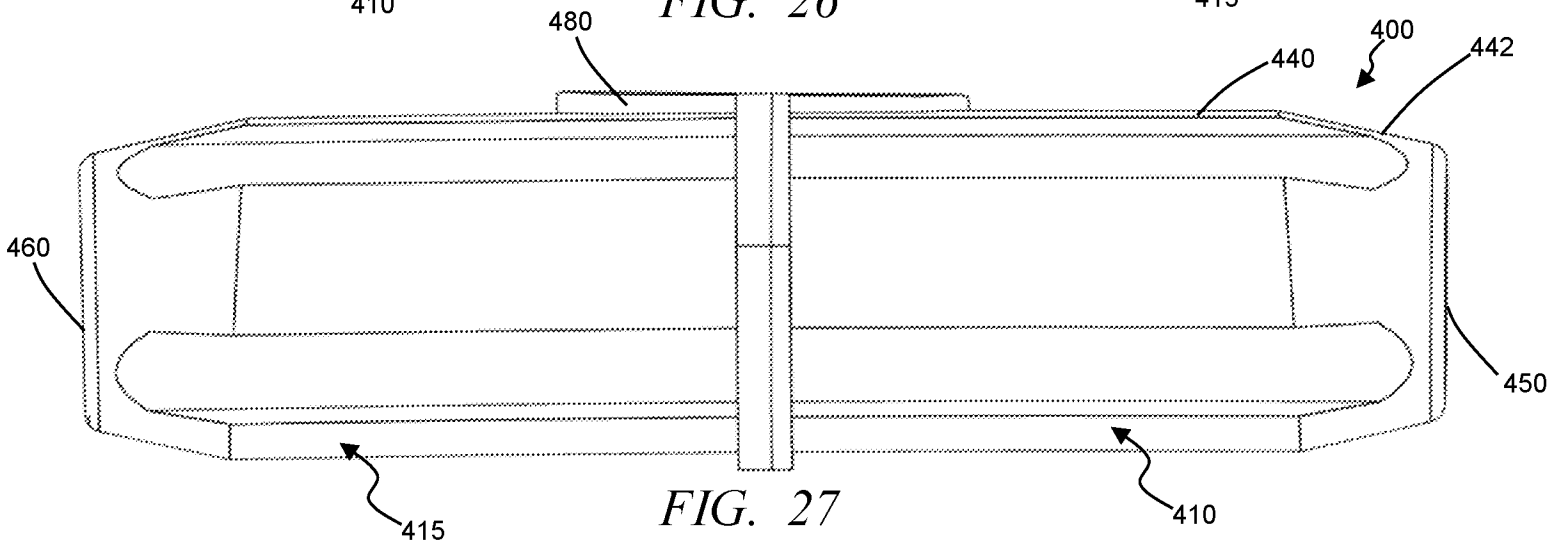
FIG. 27 is a bottom plan view of the rod connector of FIG. 25.
Figure 29:
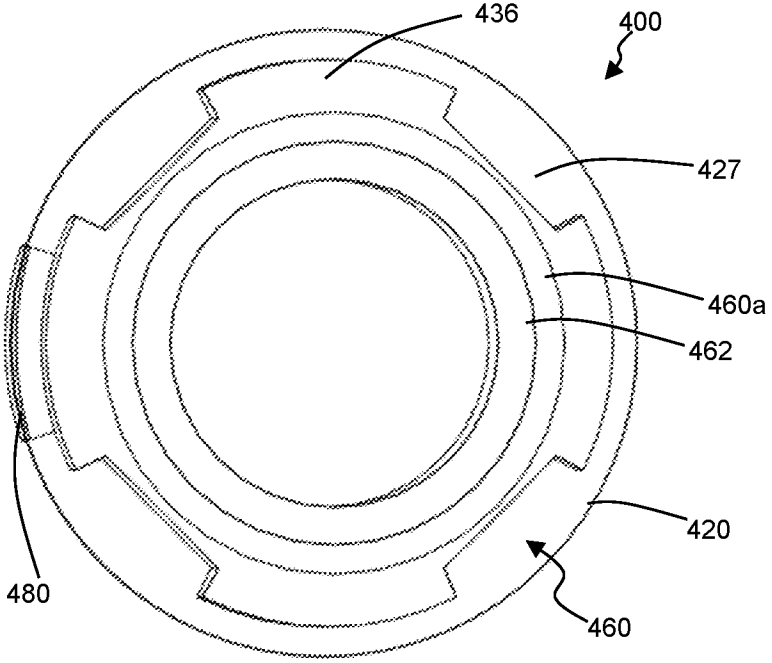
FIG. 29 is a second-end elevation view of the rod connector of FIG. 25.
Figure 28:
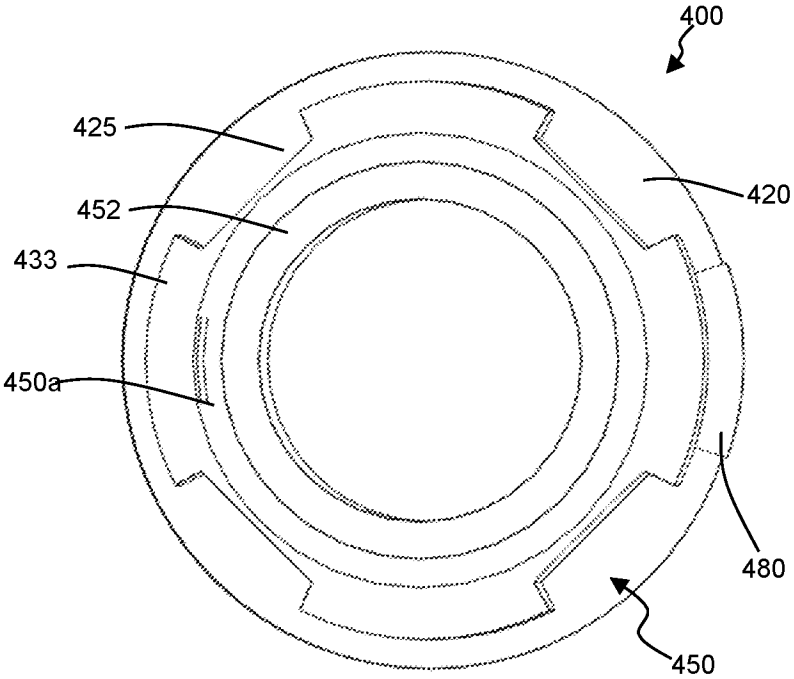
FIG. 28 is a first-end elevation view of the rod connector of FIG. 25.

The first shaft portion 310 and the second shaft portion 315 are separated by a circumferential ridge 320. Specifically, the circumferential ridge 320 projects radially outward from and about the body 305 at a midpoint or other intermediate point of the body 305. The circumferential ridge 320 may be a continuous ridge or, in other embodiments, may be a discontinuous ridge. The circumferential ridge 320 projects from the body 305 enough so that ends of the first rod 370 and the second rod 375 (FIG. 24) contact or abut side surfaces of the circumferential ridge 320 when the rod connector 300 is inserted therein. In addition, the radial extent of the circumferential ridge 320 may be selected so that the circumferential ridge 320 does not project much farther than the outer perimeters of the rods 370, 375 (FIG. 24). For instance, an outer diameter of the circumferential ridge 320 may be substantially equal to an outer diameter of the rods 370, 375 so that the outer perimeters of the rods 370, 375 are substantially level, if not level, with a radially outermost surface of the circumferential ridge 320 so that the transition between the rods 370, 375 is smooth. In other forms, the outer diameter of the circumferential ridge 320 is slightly smaller or larger than the outer diameter of the rods, though still permitting a substantially smooth transition. This smooth transitional surface permits or facilitates curtains and/or curtain rings or hooks which support a curtain to pass from the first rod 370 to the second rod 375, and vice versa, without catching on an end of a rod or the connector 300 as the curtains/curtain rings are drawn to one side or the other of the length of the rods 370, 375 (FIG. 24).

In addition, like for the rod connectors 100, 200 described above, the circumferential ridge 320 also ensures that the rod connector 300 is properly positioned and balanced within the rods 370, 375. That is, the circumferential ridge 320 acts as a stop so that only part of the rod connector 300 (e.g., the first shaft portion 310 or the second shaft portion 315) is inserted into a single rod, preventing the entire rod connector 300 or too much of the rod connector 300 from being inserted into one of the rods. In the illustrated embodiment, for example, the circumferential ridge 320 is centrally positioned between the generally equally sized first shaft portion 310 and the second shaft portion 315 so that one of the rods receives the first shaft portion 310 and the other of the rods receives the second shaft portion 315 and the rod connector 300 is equally weighted and balanced in the rods so that both rods are supported by the rod connector 300 with substantially equal strength. The circumferential ridge 320 also serves to support and keep the rods positioned relative to one another (prevent bending of the rods relative to one another) by providing a surface for the rods to abut against.

In some embodiments, the radial extent of the circumferential ridge 320 may be defined by an amount the circumferential ridge 320 projects farther than a radially outermost portion of the outer side surface 307 of the body 305. In embodiments, this radial height of the ridge may be selected to generally correspond to a wall thickness of the rods and may, for example, be from about 0.20 mm to about 1.5 mm. For instance, in one example, the circumferential ridge 320 has a radial extent of about 1.0 mm (about 0.0395 inches). In one configuration, the rod connector 300 has a maximum diameter at the side surface 307 of about 18.97 mm (0.747 inches) and a diameter at the circumferential ridge 320 of about 20.98 mm (0.826 inches).

In different configurations the maximum diameter of the rod connector 300 may vary for use with rods of varying diameters. For instance, in embodiments the rod connector 300 may be sized to have a friction fit connection with rods having outer diameters spanning from 10 mm to 35 mm.

In embodiments, the axial width of the ridge 320 (i.e., portions of the ridge 320 not part of the projection 380 and tabs 382, 384 described below) may be, for example, from about 1.0 mm to about 10.0 mm, or from about 1.6 mm to about 7.2 mm. In another approach, the axial width may be, for example, from about 4.0 mm to about 10 mm. The axial width of the ridge 320 is selected so that the ridge is durable enough to withstand the force of the rods abutting or engaging the ridge. This prevents the rods from breaking or shaving down the ridge until it becomes ineffective when the rods engage the ridge.

In some approaches, the entirety of the circumferential ridge 320 may project a uniform distance from the body 305 (i.e., having a uniform height) while in other approaches the circumferential ridge 320 may have a non-uniform height, for example, to define an arcuate or rounded profile of the ridge 320 along a length of the rod connector 300.

In certain embodiments, a length l of each shaft portion 310, 315 (i.e., the length from an end of the shaft portion to the circumferential ridge 320) is proportioned relative to a maximum diameter d of each shaft portion 310, 315. For example, the length l may be larger than the maximum diameter d. In embodiments, for instance, the ratio of the length l to the maximum diameter d is greater than about 1.0. In some embodiments, the ratio is about 1.25 or more, about 1.4 or more, about 1.5 or more, or about 1.7 or more. By these approaches or other exemplary approaches, a maximum ratio may be about 5.0. In embodiments, these ratios are effective to keep the rod connector 300 properly weighted to provide a stable connection with the rods. In some embodiments, for instance, as the diameter of the shaft increases, the longer the shaft becomes (i.e., more of the connector extends into the rod).

In addition, the length of each shaft portion may be selected based on the length of the rod connected to the shaft portion. Generally, the length of each shaft portion 310, 315 may increase as the length of the rod increases. In some embodiments, the shaft portions 310, 315 may be different lengths to correspond to rods of different lengths connected to each shaft portion 310, 315. In this approach, the circumferential ridge 320 may not be positioned centrally along the length of the rod connector 300, separating two equally long shaft portions 310, 315, but may be positioned to unequally distinguish one shaft portion from another shaft portion so that they have different lengths for proper weighting in rods of different lengths.

A plurality of longitudinal ridges 333 project radially from the body 305 along the length of the first shaft portion 310 and the second shaft portion 315. Specifically, longitudinal ridges 333 are substantially equally spaced about the first shaft portion 310 and extend lengthwise from a first end 350 of the body to the circumferential ridge 320. Similarly, longitudinal ridges 336 are spaced substantially equally about the second shaft portion 315 and extend lengthwise from a second end 360 of the body to the circumferential ridge 320. The longitudinal ridges 333, 336 have a widened radial face that defines the radially outermost surface 307 of the body 305 having a curvature that corresponds to an inner radial curvature of the rods 370, 375 so that inner surfaces of the rods 370, 375 engage portions of the longitudinal ridges 333, 336 in a friction fit connection. The ridges 333 also have a longitudinal curvature corresponding to the longitudinal curvature of the curved rods 370, 375.

The longitudinal ridges 333 define a first plurality of voids or grooves 325 therebetween on the first shaft portion 310 while the longitudinal ridges 336 define a second plurality of elongate grooves 327 therebetween on the second shaft portion 315. For instance, in one example there may be four longitudinal ridges and four elongate grooves defined between the four longitudinal ridges on each of the first shaft portion 310 and the second shaft portion 315. In other approaches, there may be four, five, six, seven, eight, or more of the longitudinal ridges and corresponding grooves.

The radially outermost surfaces 307 of the body 305 defined by the longitudinal ridges 333, 336 may each have a generally rectangular profile. The grooves 325, 327 may also be correspondingly rectangular. As illustrated, the sides 338 of the longitudinal ridges 333, 336 defining the sides of the grooves 325, 327 may be curved or rounded. For instance, in the illustrated embodiment, rounded or curved sides 338 cause a cross-sectional width and area of the groove to be smaller at the bottom of the groove than at the top of the recess.

There is a single discrete ridge 333, 336 between each of the grooves 325, 327 so that each ridge defines a single step from each side of each groove 325, 327.

Generally, the dimensions and amounts of the longitudinal ridges 333, 336 and grooves 325, 327 are selected to provide an optimal amount of friction between the rod connector 300 and the rods and also reduce material costs. For instance, since the grooves 325, 327 do not contact the rods, they reduce the frictional engagement between the rod connector 300 and the rods to facilitate insertion and removal of the rod connector 300 from the rods.

In some embodiments, a total outermost area of the grooves 325, 327 at the outer side surface 307 may be proportioned relative to the total area of the outer side surface 307 or longitudinal ridges 333, 336. For instance, in embodiments, a ratio of the area of the grooves 325, 327 to an area of the longitudinal ridges 333, 336 or outer side surface 307 may be at least about 0.5, at least about 0.6, at least about 0.7, at least about 1, at least about 1.2, at least about 1.5, or at least about 2.0. In some approaches, a maximum ratio of the area of the grooves 325, 327 to an area of the longitudinal ridges 333, 336 or outer side surface 307 may be about 10. In one approach, the ratio may be about 0.6 to about 5.0.

In some embodiments, the grooves 325, 327 may comprise at least 20%, at least 30%, at least 40%, or at least 50% of the outer sides of the rod connector 300. In these approaches, or other exemplary approaches, a maximum amount may be about 80%. In some approaches, the maximum amount may be about 70%.

In some embodiments, the longitudinal ridges 333, 336 each have a first portion 340 and a second portion 342. The first portions 340 are adjacent the circumferential ridge 320 and may be contiguous therewith, with the circumferential ridge 320 having a radial extent greater than that of the first portions 340. The second portions 342 may be angled radially inward with respect to the first portions 340. In certain embodiments, the second portions 342 extend from the first portions 340 to a corresponding respective end 350, 360 of the body 305 and have a radial extent that gradually tapers radially inward so that a radial extent of the second portion 342 at the corresponding end 350, 360 is less than a radial extent of the second portion 342 adjacent the first portion 340 and less than a radial extent of the first portion 340. The second portions 342 may have an angled or curved outer surface along its length to define the taper. The second portions 342 of the longitudinal ridges 333, 336 spaced about the body 305 provide a gradually decreasing diameter of the body 305 of the rod connector 300 towards each respective end 350, 360 of the rod connector 300 to facilitate insertion of the connector 300 into the rods.

In some embodiments, at least some of the radially outermost surfaces 307 defined by the ridges 333, 336 are slightly curved lengthwise along the connector 300 to correspond to a curvature along the length of the curved rods 370, 375 (FIG. 24) when the rod connector 300 is inserted therein. For instance, the radially outermost surfaces 307 of at least some of the ridges 333, 336 may slightly curve or slope lengthwise along the rod connector 300 from the circumferential ridge 320. In some cases, the curvature may be so slight at the area of connection between the rods 370, 375 that the rod connector 300 may appear substantially linear. The slight curvature of the longitudinal ridges 333, 336 permits a friction fit with the curved rods 370, 375 (FIG. 24) to secure the connector 300 thereto.

In one example, at least one first longitudinal ridge 333 on the first shaft portion 310 and at least one second longitudinal ridge 336 on the second shaft portion 315 that is longitudinally aligned with the first longitudinal ridge 333 may symmetrically curve radially inwardly to correspond to an outer curve of the rods 370, 375 (FIG. 24). In addition, at least one third longitudinal ridge 333 on the first shaft portion 310 and at least one fourth longitudinal ridge 336 on the second shaft portion 315 that is longitudinally aligned with the second longitudinal ridge 333 may symmetrically curve radially outwardly to correspond to an inner curve of the rods 370, 375 (FIG. 24).

The circumferential ridge 320 projects farther radially outwardly than the longitudinal ridges 333, 336. In this manner, the inner surfaces of the rods 370, 375 (FIG. 24) engage portions of the longitudinal ridges 333, 336 while the terminal ends of the rods abut the circumferential ridge 320 when the rod connector 300 is inserted into the rods.

Each end 350, 360 of the rod connector 300 may have a respective annular face 352, 362. In some embodiments, there is an angled circumferential transitional surface 339*a*, 339*b* between the annular faces 352, 362 and the ridges 333, 336.

Figure 16:
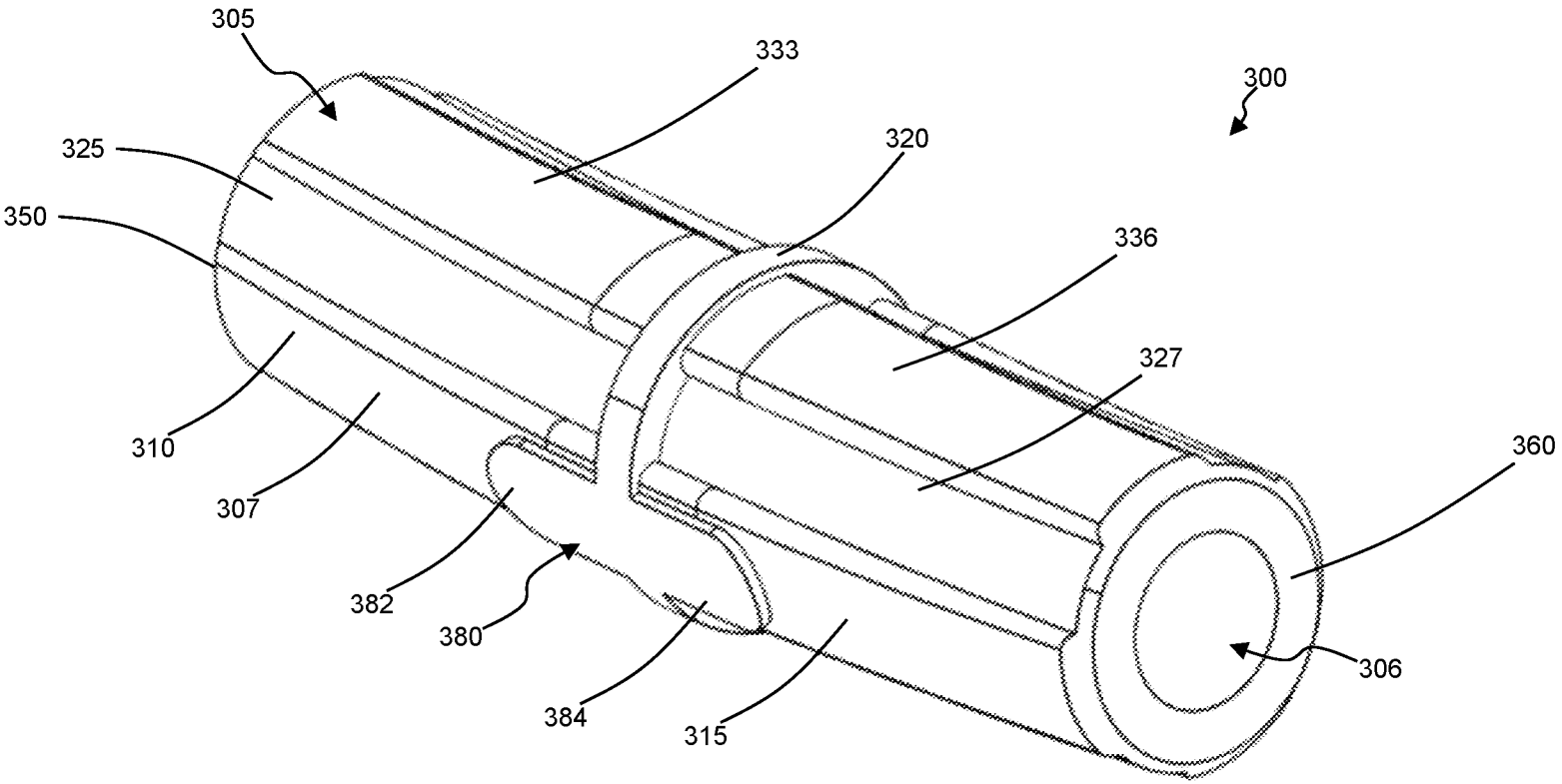
FIG. 16 is a front-side perspective view of a rod connector according to a third embodiment.
Figure 17:
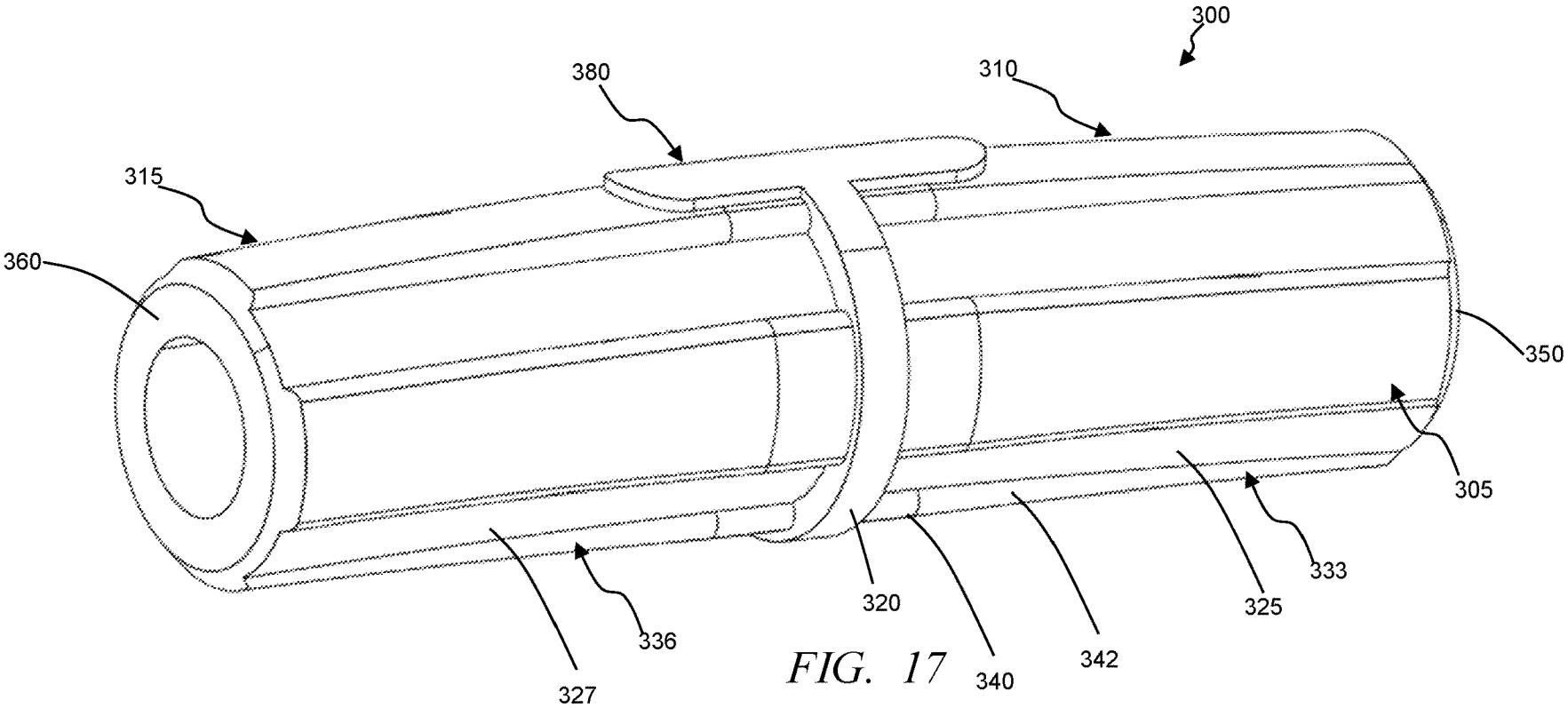
FIG. 17 is a top-side perspective view of the rod connector of FIG. 16.
Figure 18:
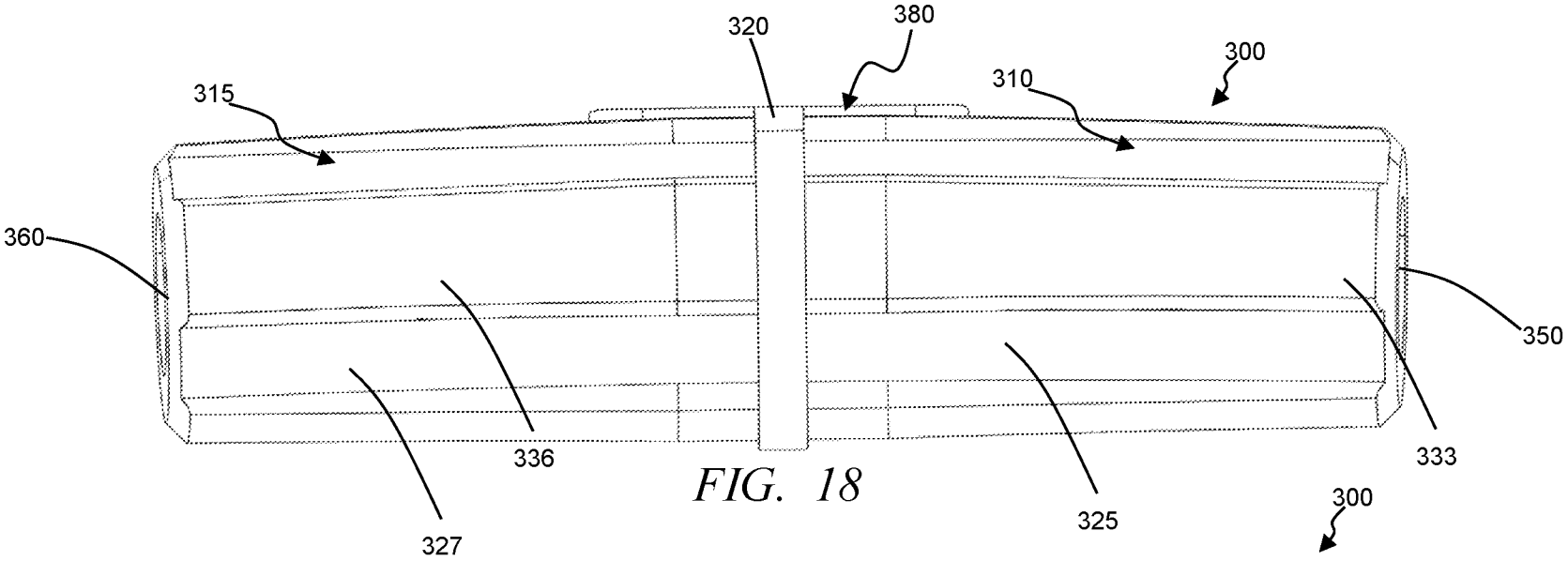
FIG. 18 is a top plan view of the rod connector of FIG. 16.
Figure 19:
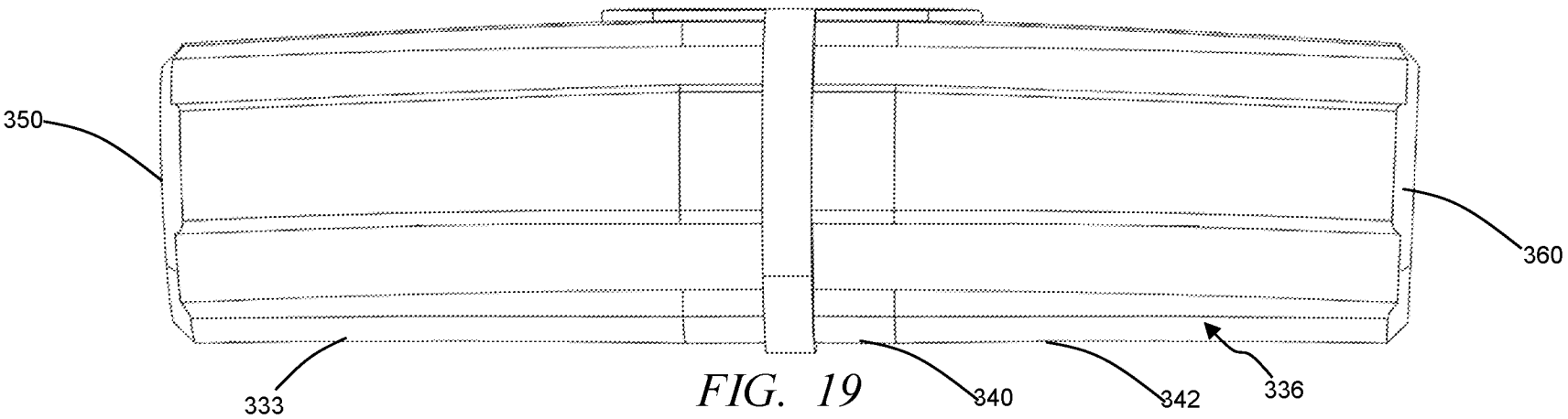
FIG. 19 is a bottom plan view of the rod connector of FIG. 16
Figure 20:
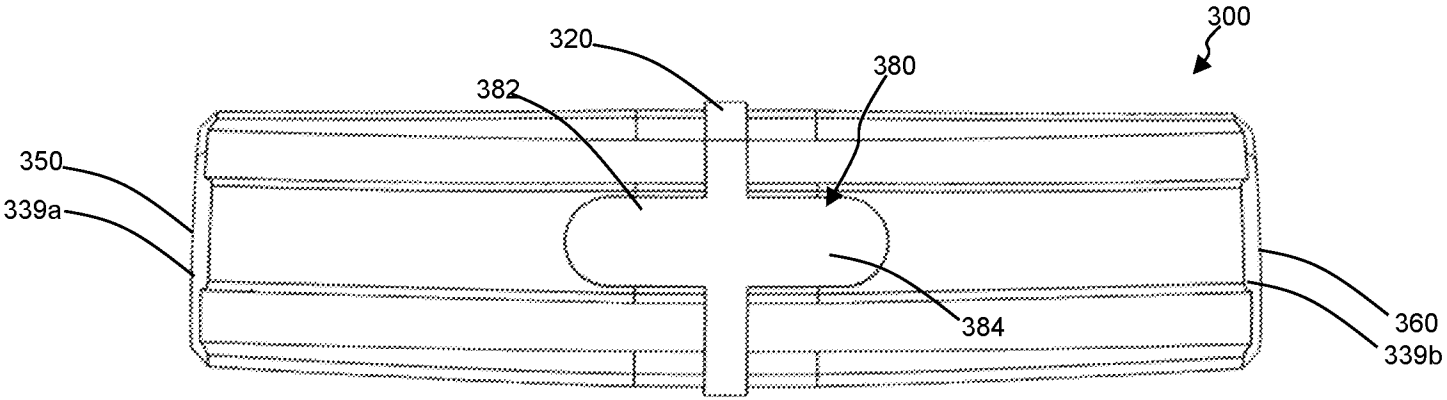
FIG. 20 is a front-side elevation view of the rod connector of FIG. 16.
Figure 21:
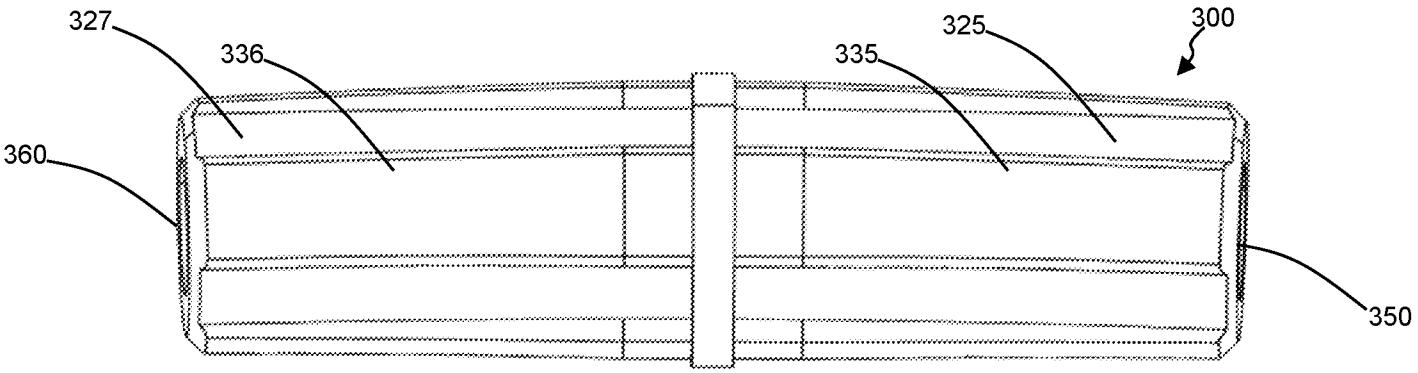
FIG. 21 is a back-side elevation view of the rod connector of FIG. 16.
Figure 23:
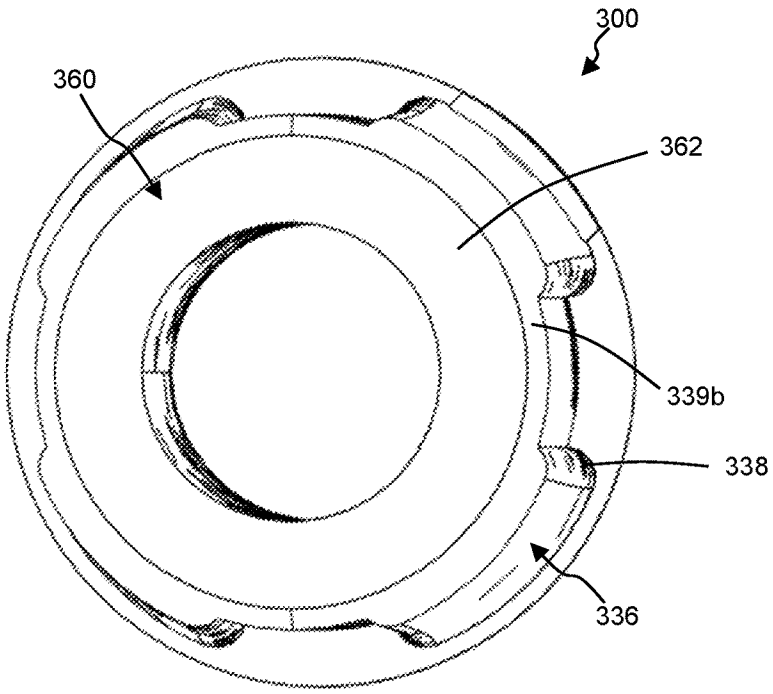
FIG. 23 is a second-end elevation view of the rod connector of FIG. 16.
Figure 22:
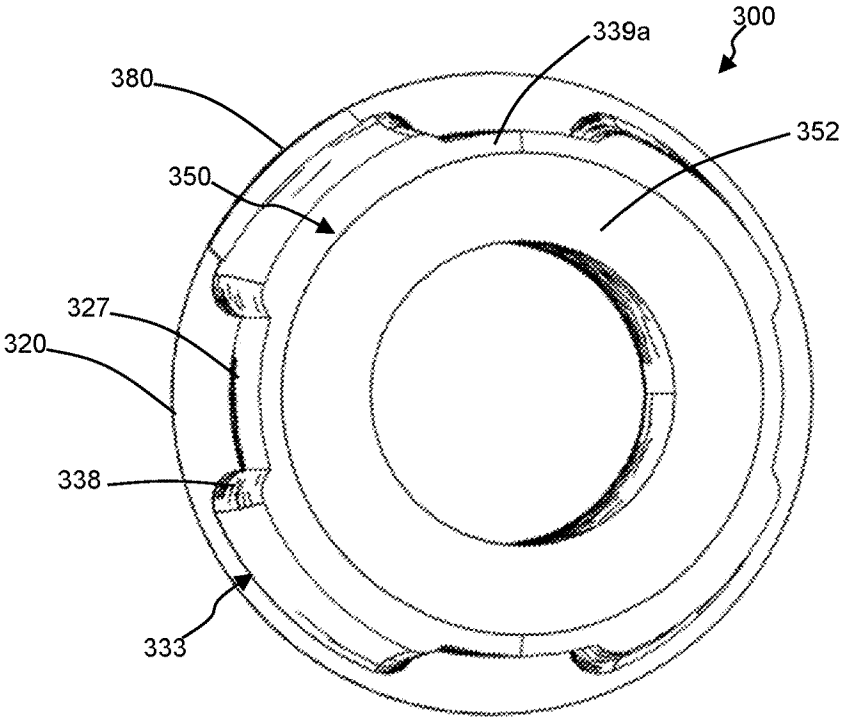
FIG. 22 is a first-end elevation view of the rod connector of FIG. 16.

With reference to FIGS. 16 and 24, the rod connector 300 additionally includes a projection 380 defining at least one tab. In embodiments, the projection 380 defines a first tab 382 and a second tab 384. The two tabs 382, 384 of the projection 380 extend axially from each side of the circumferential ridge 320. Specifically, in embodiments, one tab 382 extends from the circumferential ridge 320 on top of one of the plurality of longitudinal ridges 233 on the first shaft 310 and the other tab 384 extends from the circumferential ridge 320 on top of one of the second plurality of longitudinal ridges 236 that is longitudinally aligned with the first longitudinal ridge 233. In certain embodiments, the projection 380 is integral and substantially radially level with the circumferential ridge 320 forming a continuous surface between the circumferential ridge 320 and the projection 380. When the rod connector 300 is configured for curved rods, the tabs 382, 384 follow the curvature of the longitudinal ridges 333, 336. It is noted that rod connectors configured for use with straight rods (e.g. rod connector 100) may also include a projection and tabs like projection 380 and tabs 382, and these features may be present on any of the rod connectors described herein with corresponding slots in the rods. In some embodiments, the tabs 382, 384 may simply be positioned on a central portion of the body 305 adjacent the circumferential ridge 320 and not necessarily specifically positioned extending along a longitudinal ridge 333, 336.

The tabs 382, 384 of the projection 380 are sized for being received in corresponding slots 370*a*, 375*a* defined in the side walls of the rods 370, 375 at terminal ends thereof. Thus, when the rod connector 300 is inserted into the rods 370, 375 to connect the rods 370, 375, the tabs 382, 384 are aligned with and positioned within the slots 370*a*, 375*a*. For curved rods in particular, the tabs 382, 384 assist with registering the rod connector 300 within the rods 370, 375 so that the curvature of the rod connector 300 is correctly aligned with the curvature of the rods 370, 375. The tabs 382, 384 also prevent rotation of the rod connector 300 relative to the rods 370, 375 when installed. While the illustrated embodiment shows one projection containing two opposing tabs, in some embodiments there may be additional projections spaced about the rod connector 300. The tabs 382, 384 and slots 370*a*, 375*a* may have any suitable profile (e.g., rectangular, oval, rounded, etc.) and typically extend a small portion of the length of each respective shaft portion 310, 315 (e.g., less than 50% or less than 30% of the length).

When the rod connector 300 is installed in the rods 370, 375, the tabs 382, 384 may be substantially level with the outer surface of the rods 370, 375, forming a substantially continuous surface so that the transition over the rod connector 300 is smooth. In some embodiments, the tabs 382, 384 and/or circumferential ridge 320 may extend slightly farther than the outer surface of the rods 370, 375 (e.g., less than 1.0 mm, or less than 0.5 mm) while still maintaining a substantially smooth transition.

With reference to FIGS. 25-31, a rod connector 400 is shown according to a fourth embodiment. The rod connector 400 is adapted for use with curved rods, though in other configurations may be adapted for use with linear rods.

Many of the features of the rod connector 400 are the same as those discussed above for rod connector 300. The common features may not be specifically referenced in this description of rod connector 400 but are incorporated by reference and are denoted with the same number except that the number begins with a "4".

Like rod connector 300, the rod connector 400 includes a first shaft portion 410, a second shaft portion 415, a circumferential ridge 420 therebetween, and longitudinal ridges 433, 436 and grooves 425, 427 disposed about the first and second shaft portions 410, 415. The rod connector 400 also includes a projection 480 having two tabs 482, 484 to be received in corresponding slots 470*a*, 475*a* at the ends of the rods 470, 475.

One difference between the rod connector 400 and the rod connector 300 is that for the rod connector 400 the first portion 440 of the longitudinal ridges 433, 436 is significantly longer and the second portion 442 that angle radially inwardly relative to the first portion 440 is significantly shorter. For instance, the first portions 440 of the longitudinal ridges 433, 436 may extend more than 50% of the length of each shaft portion 410, 415. The first portions 440 may be curved longitudinally to correspond to a curvature of curved rods. In some embodiments, the first portions 440 are substantially linear to correspond to straight rods.

Figure 30:
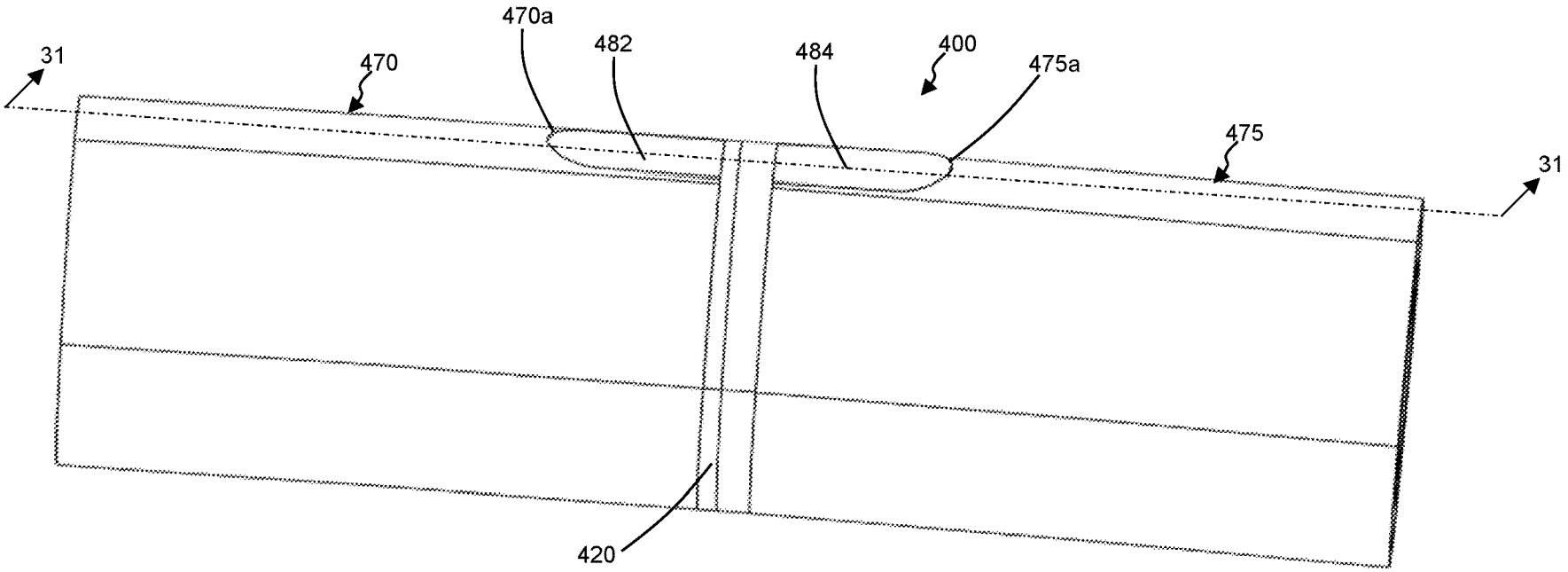
FIG. 30 is a top perspective view of the rod connector of FIG. 25 connecting two rods.
Figure 31:
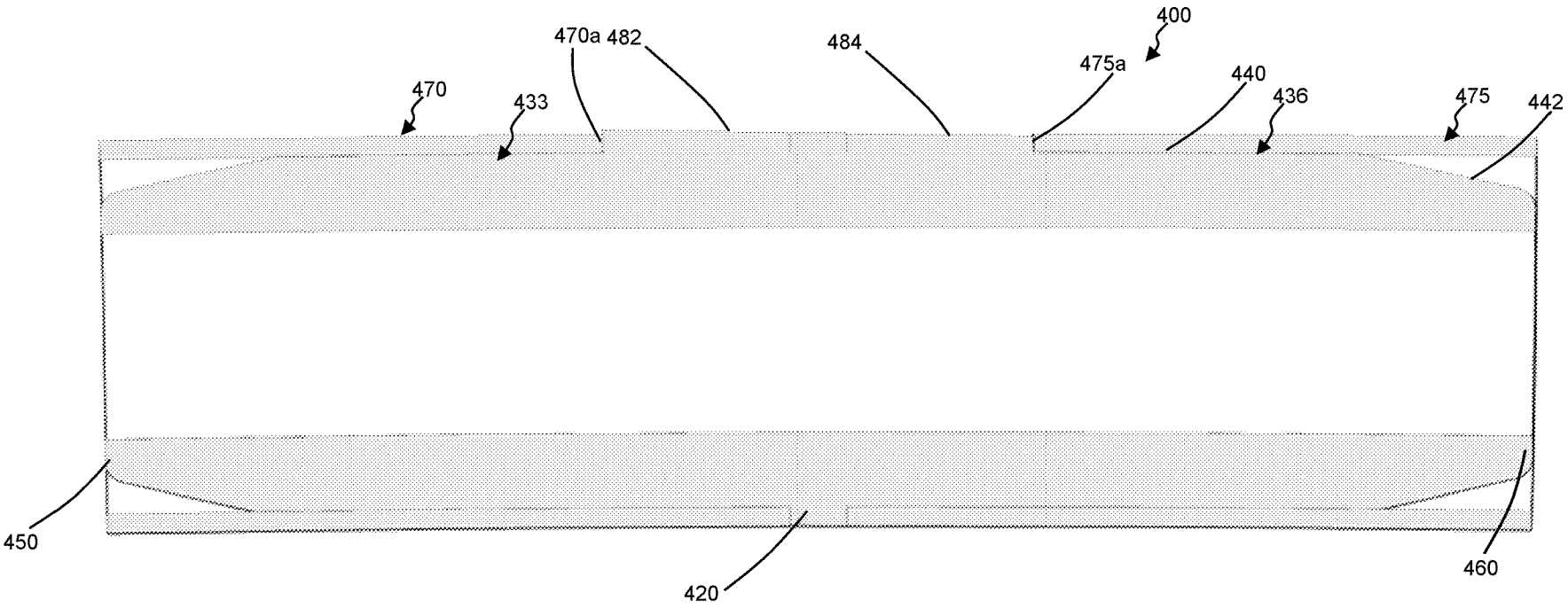
FIG. 31 is a cross sectional view of the rod connector of FIG. 25 connecting two rods taken along line 31-31 of FIG. 30.

FIGS. 30 and 31 illustrate the rod connector 400 inserted within the rods 470, 475, with the tabs 482, 484 inserted within respective slots 470*a*, 475*a* of the rods 470, 475. As illustrated, the ends of the rods 470, 475 engage the circumferential ridge 420 and the outer surfaces of the rods 470, 475, the circumferential ridge 420, and the tabs 482, 484 define a substantially continuous and smooth transition over the rod connector 400.

The rod connectors 100, 200, 300, and 400 disclosed herein, or any variation thereof, may be formed of a plastic material, such as acrylonitrile butadiene styrene (ABS) or nylon. In other approaches, the rod connectors disclosed herein may be formed of a metal material (e.g., steel, zinc, or aluminum) or made of carbon fiber. Advantageously, the rod connectors may be configured as a single, integral piece, which provides easy installation. The rod connectors may be a molded or cast component.

While there have been illustrated and described particular embodiments of the present invention, those skilled in the art will recognize that a wide variety of modifications, alterations, and combinations can be made with respect to the above-described embodiments without departing from the scope of the invention, and that such modifications, alterations, and combinations are to be viewed as being within the ambit of the inventive concept.

What is claimed is:

1. A rod connector comprising:

a one-piece body, the one-piece body defining a first shaft portion configured to engage a first rod, a second shaft portion configured to engage a second rod, and a circumferential ridge projecting radially from the body between the first shaft portion and the second shaft portion, the circumferential ridge directly engaging the first shaft portion and the second shaft portion and being entirely solid, wherein the first shaft portion includes a first outer surface, the second shaft portion includes a second outer surface, and voids are formed in the first outer surface and the second outer surface, wherein respective bottoms of the voids are recessed from the first outer surface or the second outer surface, wherein a ratio between an area of the voids and an area of the first and second outer surfaces is from about 0.6 to about 5.

2. The rod connector of claim 1, wherein the one-piece body has a solid core.

3. The rod connector of claim 1, wherein the voids are grooves extending longitudinally between adjacent longitudinally extending ribs carrying the first outer surface and the second outer surface.

4. The rod connector of claim 1, wherein a ratio of a length of the first shaft portion to a maximum diameter of the first shaft portion is about 1.25 or more.

5. A rod connector comprising:

a one-piece body, the one-piece body defining a first shaft portion configured to engage a first rod, a second shaft portion configured to engage a second rod, and a circumferential ridge projecting radially from the body between the first shaft portion and the second shaft portion, the circumferential ridge directly engaging the first shaft portion and the second shaft portion and being entirely solid, wherein the first shaft portion includes a first outer surface, the second shaft portion includes a second outer surface, and voids are formed in the first outer surface and the second outer surface, wherein respective bottoms of the voids are recessed from the first outer surface or the second outer surface, wherein the voids define radially positioned groupings of distinct pockets in series along an axis of the one-piece body.

6. A rod connector comprising:

a one-piece body, the one-piece body defining a first shaft portion configured to engage a first rod, a second shaft portion configured to engage a second rod, and a circumferential ridge projecting radially from the body between the first shaft portion and the second shaft portion, the circumferential ridge directly engaging the first shaft portion and the second shaft portion and being entirely solid, wherein the first shaft portion includes a first outer surface, the second shaft portion includes a second outer surface, and voids are formed in the first outer surface and the second outer surface, wherein respective bottoms of the voids are recessed from the first outer surface or the second outer surface, the rod connector further comprising at least one tab extending axially from the circumferential ridge, an outer surface thereof defining a substantially continuous surface with the circumferential ridge.

7. The rod connector of claim 6, wherein a first tab of the at least one tab extends along a first outer surface of the first shaft portion and a second tab of the at least one tab extends along a second outer surface of the second shaft portion.

8. The rod connector of claim 7, wherein the first tab extends along a first longitudinal ridge of the first shaft portion and the second tab extends along a second longitudinal ridge of the second shaft portion.

9. The rod connector of claim 7, wherein the outer surface of the first tab and the second tab each have a longitudinal curvature.

10. A rod connector comprising:

a one-piece body, the one-piece body defining a first shaft portion configured to engage a first rod, a second shaft portion configured to engage a second rod, and a circumferential ridge projecting radially from the body between the first shaft portion and the second shaft portion, the circumferential ridge directly engaging the first shaft portion and the second shaft portion and being entirely solid, wherein the first shaft portion includes a first outer surface, the second shaft portion includes a second outer surface, and voids are formed in the first outer surface and the second outer surface, wherein respective bottoms of the voids are recessed from the first outer surface or the second outer surface, wherein the first shaft portion includes first longitudinal ridges projecting radially from the body and extending between the circumferential ridge and a first end of the rod connector and the second shaft portion includes second longitudinal ridges projecting radially from the body extending from between the circumferential ridge and a second end of the rod connector; and the first longitudinal ridges each include a first segment adjacent the circumferential ridge and a second segment angled relative to the first segment and between the first segment and the first end that is tapered.

11. A rod system, comprising:

a first hollow rod;

a second hollow rod; and a rod connector, the rod connector comprising a one-piece body defining a first shaft portion for engaging the first rod, a second shaft portion for engaging the second rod, and a circumferential ridge projecting radially from the body between the first shaft portion and the second shaft portion, wherein the first rod and the second rod have a first outer diameter substantially the same as a second outer diameter of the circumferential ridge such that when the first rod and the second rod engage the first shaft portion and the second shaft portion, respectively, until the first rod and the second rod are adjacent the circumferential ridge, a substantially smooth transition is provided between the first rod, the circumferential ridge, and the second rod, wherein the first shaft portion includes a first outer surface and the second shaft portion includes a second outer surface, the first and second outer surfaces sized to engage the first and second rod, respectively, in a friction fit connection, the first outer surface and the second outer surface including voids, wherein respective bottoms of the voids are recessed from the first outer surface or the second outer surface, wherein a ratio between an area of the voids and an area of the first and second outer surfaces is from about 0.6 to about 5.0.

12. The rod system of claim 11, wherein the one-piece body has a solid core.

13. The rod system of claim 11, wherein a first tab and a second tab extend axially from opposing sides of the circumferential ridge and outer surfaces of the first tab and the second tab define a substantially continuous surface with the circumferential ridge.

14. The rod system of claim 13, wherein the first rod includes a first slot sized to receive the first tab when the first shaft portion engages the first rod and the second rod includes a second slot sized to receive the second tab when the second shaft portion engages the second rod.

15. The rod system of claim 14, wherein the first and second rods are curved rods and the first shaft portion and the second shaft portion have a curvature corresponding to the first and second rods, and wherein the first tab, the second tab, the first slot, and the second slot are positioned so that the curvatures of the first shaft portion and the second shaft portion align with a corresponding curvature of the first and second rods.

16. The rod system of claim 11, wherein the first and second rods are curved rods and the rod connector is curved to correspond to a curvature of the first and second rods.

* * * * *